US012710186B2

(12) United States Patent
Aggarwal et al.

(10) Patent No.: US 12,710,186 B2
(45) Date of Patent: Aug. 18, 2026

(54) METHODS AND SYSTEMS FOR CONTROLLING AN HVAC SYSTEM TO IDENTIFY ENERGY USAGE UNDER DIFFERENT CONTROL STRATEGIES

(71) Applicant: Honeywell International Inc., Charlotte, NC (US)

(72) Inventors: Kanchan Aggarwal, Karnatka (IN); Madhav Kamath, Karnataka (IN); Magesh Lingan, Bangalore (IN); Prabhat Ranjan, Bangalore (IN)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 537 days.

(21) Appl. No.: 18/455,318

(22) Filed: Aug. 24, 2023

(65) Prior Publication Data

US 2025/0067452 A1 Feb. 27, 2025

(51) Int. Cl.
*F24F 11/46* (2018.01)
*F24F 11/30* (2018.01)
(Continued)

(52) U.S. Cl.
CPC ..... *F24F 11/46* (2018.01); *F24F 11/30* (2018.01); *F24F 11/52* (2018.01); *F24F 11/63* (2018.01); *F24F 11/74* (2018.01)

(58) Field of Classification Search
CPC .. F24F 11/30; F24F 11/46; F24F 11/50; F24F 11/52; F24F 11/523; F24F 11/70; F24F 11/72; F24F 11/74; F24F 11/80
(Continued)

(56) References Cited

U.S. PATENT DOCUMENTS 10,605,477 B2 * 3/2020 Ridder ..... F24F 11/84
11,675,320 B2 * 6/2023 Burroughs ..... G05B 13/041 700/275
(Continued)

FOREIGN PATENT DOCUMENTS

CN 107329463 A 11/2017
CN 108431510 B 8/2020
(Continued)

OTHER PUBLICATIONS

Hoyt, "Extending Air Temperature Setpoints: Simulated Energy Savings and Design Considerations for New and Retrofit Buildings," UC Berkeley Indoor Environmental Quality (IEQ), 21 pages, Sep. 1, 2014.
(Continued)

*Primary Examiner* — Crystal J Barnes-Bullock
(74) *Attorney, Agent, or Firm* — Seager, Tufte & Wickhem, LLP

(57) ABSTRACT

A method for determining a measure of thermal energy delivered via a VAV box includes receiving an AHU supply air temperature, a VAV discharge air temperature, a space air temperature, and a VAV discharge flow rate. The measure of thermal energy delivered by the VAV box to the space during the first period of time is determined based at least in part on three or more of the received parameters. The determined measure of thermal energy delivered by the VAV box and a determined measure of thermal energy delivered by each of a plurality of other VAV boxes of the facility are aggregated over the first period of time, resulting in an aggregated measure of thermal energy. This may be used to adjust one or more control parameters to achieve a desired balance of energy consumption versus comfort, energy and/or health.

20 Claims, 14 Drawing Sheets

(51) Int. Cl.
*F24F 11/52* (2018.01)
*F24F 11/63* (2018.01)
*F24F 11/74* (2018.01)

(58) Field of Classification Search
USPC ..... 700/278
See application file for complete search history.

(56) References Cited

U.S. PATENT DOCUMENTS

| | | | | |
|---|---|---|---|---|
| 11,719,457 | B2 * | 8/2023 | Delgoshaei | F24F 11/65 700/276 |
| 12,105,487 | B2 * | 10/2024 | Baumgartner | G05B 15/02 |
| 12,372,934 | B2 * | 7/2025 | Risbeck | G06F 30/13 |
| 12,442,553 | B2 * | 10/2025 | Peterson | F24F 11/30 |
| 12,529,490 | B2 * | 1/2026 | Douglas | F24F 11/46 |
| 12,546,499 | B2 * | 2/2026 | Risbeck | F24F 11/63 |
| 12,584,648 | B2 * | 3/2026 | Risbeck | F24F 11/63 |
| 2022/0057099 | A1 | 2/2022 | Clement et al. | |

FOREIGN PATENT DOCUMENTS

| | | | |
|---|---|---|---|
| JP | 2023016480 | A | 2/2023 |
| KR | 2013117188 | A | 10/2013 |

OTHER PUBLICATIONS

Lu et al., "Energy Savings of Retrofitting Residential Buildings with Variable Air Volume Systems across Different Climates," Purdue University, School of Mechanical Engineering, 24 pages, 2020.

Xu et al., "Capturing Energy Savings from Correcting VAV Box Minimums on Campus," UC Berkeley HVAC Systems, 38 pages, May 1, 2021.

Extended Search Report, EP Application No. 24191877.0, European Patent Office, Nov. 21, 2024 (7 pages).

* cited by examiner

METHODS AND SYSTEMS FOR CONTROLLING AN HVAC SYSTEM TO IDENTIFY ENERGY USAGE UNDER DIFFERENT CONTROL STRATEGIES

TECHNICAL FIELD

The present disclosure relates to methods and systems for controlling operation of an HVAC (Heating, Ventilating and Air Conditioning) system and more particularly to methods and systems for demonstrating energy efficiency in controlling operation of an HVAC system.

BACKGROUND

Building management systems that support operations within a facility may include, for example, security systems, HVAC (Heating, Ventilating and Air Conditioning) systems, and others. An HVAC system can consume considerable amounts of energy in maintaining optimal comfort conditions within the facility. Operating conditions such as temperature setpoints, for example, may be adjusted for energy savings. What would be desirable are methods and systems that demonstrate the energy savings resulting from changes in control parameters while operating the HVAC system.

SUMMARY

The present disclosure relates to methods and systems for demonstrating energy efficiency in controlling operation of an HVAC system. An example may be found in a method for determining a measure of thermal energy delivered via a Variable Air Volume (VAV) box to a space of a facility. The VAV box receiving a supply air from an Air Handler Unit (AHU) of a Heating, Ventilating and/or Air Conditioning (HVAC) system of the facility and providing a VAV discharge air flow to the space of the facility. The illustrative method includes receiving an AHU supply air temperature ($TAHU_{SAT}$) that is representative of the temperature of the supply air that is received from the AHU by the VAV box, receiving a VAV discharge air temperature ($T_{DAT}$) that is representative of the temperature of the VAV discharge air flow provided to the space by the VAV box, receiving a space air temperature ($T_{SPACE}$) that is representative of the temperature of the air in the space, and/or receiving a VAV discharge flow rate ($VAV_{FLOWRATE}$) that is representative of a flow rate of the VAV discharge air flow provided to the space by the VAV box. The flow rate may be provided by a flow sensor, or may be derived from a fan speed or the like. The method includes controlling the HVAC system of the facility using first control parameters over a first period of time. The measure of thermal energy delivered by the VAV box to the space during the first period of time is determined based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$). The determined measure of thermal energy delivered by the VAV box and a determined measure of thermal energy delivered by each of a plurality of other VAV boxes of the facility are aggregated over the first period of time, resulting in a first aggregated measure of thermal energy. The method includes controlling the HVAC system of the facility using second control parameters over a second period of time. The measure of thermal energy delivered by the VAV box to the space during the second period of time is determined based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$). The determined measure of thermal energy delivered by the VAV box and the determined measure of thermal energy delivered by each of the plurality of other VAV boxes of the facility are aggregated over the second period of time, resulting in a second aggregated measure of thermal energy. The first aggregated measure of thermal energy and the second aggregated measure of thermal energy are displayed on a display to help identify the effectiveness in controlling the HVAC system using the first control parameters relative to the second control parameters.

Another example may be found in a Heating, Ventilating and/or Air Conditioning (HVAC) system of a facility, wherein the HVAC system includes a Variable Air Volume (VAV) box receiving a supply air from an Air Handler Unit (AHU) of the HVAC system and providing a VAV discharge air flow to a space of the facility. The HVAC system includes an AHU supply air temperature sensor for providing an AHU supply air temperature ($TAHU_{SAT}$) that is representative of the temperature of the supply air that is received from the AHU by the VAV box, a VAV discharge air temperature sensor for providing a VAV discharge air temperature ($T_{DAT}$) that is representative of the temperature of the VAV discharge air flow provided to the space by the VAV box, a space air temperature sensor for providing a space air temperature ($T_{SPACE}$) that is representative of the temperature of the air in the space, a VAV discharge flow rate sensor for providing a VAV discharge flow rate ($VAV_{FLOWRATE}$) that is representative of a flow rate of the VAV discharge air flow provided to the space by the VAV box, and a controller that is operatively coupled to the AHU supply air temperature sensor, the VAV discharge air temperature sensor, the space air temperature sensor and the VAV discharge flow rate sensor. The controller is configured to control the HVAC system of the facility using first control parameters over a first period of time. The controller is configured to determine a measure of thermal energy delivered by the VAV box to the space based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$). The controller is configured to aggregate the determined measure of thermal energy delivered by the VAV box and a determined measure of thermal energy delivered by each of a plurality of other VAV boxes of the facility over the first period of time, resulting in a first aggregated measure of thermal energy. The controller is configured to control the HVAC system of the facility using second control parameters over a second period of time. The controller is configured to determine a measure of thermal energy delivered by the VAV box to the space based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$). The controller is configured to aggregate the determined measure of thermal energy delivered by the VAV box and the determined measure of thermal energy delivered by each of the plurality of other VAV boxes of the facility over the second period of time, resulting in a second aggregated measure of thermal energy. The controller is configured to display the first aggregated measure of thermal energy and the second aggregated measure of thermal energy on a display to help identify the effectiveness in controlling the HVAC system using the first control parameters relative to the second control parameters.

Another example may be found in a Heating, Ventilating and/or Air Conditioning (HVAC) system of a facility, wherein the HVAC system includes a Variable Air Volume (VAV) box receiving a supply air from an Air Handler Unit (AHU) of the HVAC system and providing a VAV discharge air flow to a space of the facility. The HVAC system includes an AHU supply air temperature sensor for providing an AHU supply air temperature ($TAHU_{SAT}$) that is representative of the temperature of the supply air that is received from the AHU by the VAV box, a VAV discharge air temperature sensor for providing a VAV discharge air temperature ($T_{DAT}$) that is representative of the temperature of the VAV discharge air flow provided to the space by the VAV box, a space air temperature sensor for providing a space air temperature ($T_{SPACE}$) that is representative of the temperature of the air in the space, a VAV discharge flow rate sensor for providing a VAV discharge flow rate ($VAV_{FLOWRATE}$) that is representative of a flow rate of the VAV discharge air flow provided to the space by the VAV box, and a controller that is operatively coupled to the AHU supply air temperature sensor, the VAV discharge air temperature sensor, the space air temperature sensor and the VAV discharge flow rate sensor, The controller is configured to control the HVAC system of the facility using first control parameters over each of a plurality of operating conditions and to determine a measure of thermal energy delivered by the VAV box to the space under each of the plurality of operating conditions based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$). The controller is configured to refine a baseline thermal energy consumption model of the facility based at least in part on the determined measure of thermal energy delivered by the VAV box to the space under each of the plurality of operating conditions. The controller is configured to control the HVAC system of the facility using second control parameters under a particular operating condition. The controller is configured to determine a measure of thermal energy delivered by the VAV box to the space under the particular operating condition based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$). The controller is configured to compare the measure of thermal energy delivered by the VAV box while controlling the HVAC system of the facility using the second control parameters under the particular operating condition with a baseline measure of thermal energy generated using the baseline thermal energy consumption model. Based at least in part on the comparison, the controller is configured to determine a relative performance of controlling the HVAC system of the facility using the second control parameters versus controlling the HVAC system of the facility using the first control parameters.

The preceding summary is provided to facilitate an understanding of some of the innovative features unique to the present disclosure and is not intended to be a full description. A full appreciation of the disclosure can be gained by taking the entire specification, claims, figures, and abstract as a whole.

BRIEF DESCRIPTION OF THE FIGURES

The disclosure may be more completely understood in consideration of the following description of various examples in connection with the accompanying drawings, in which.

Figure 1:
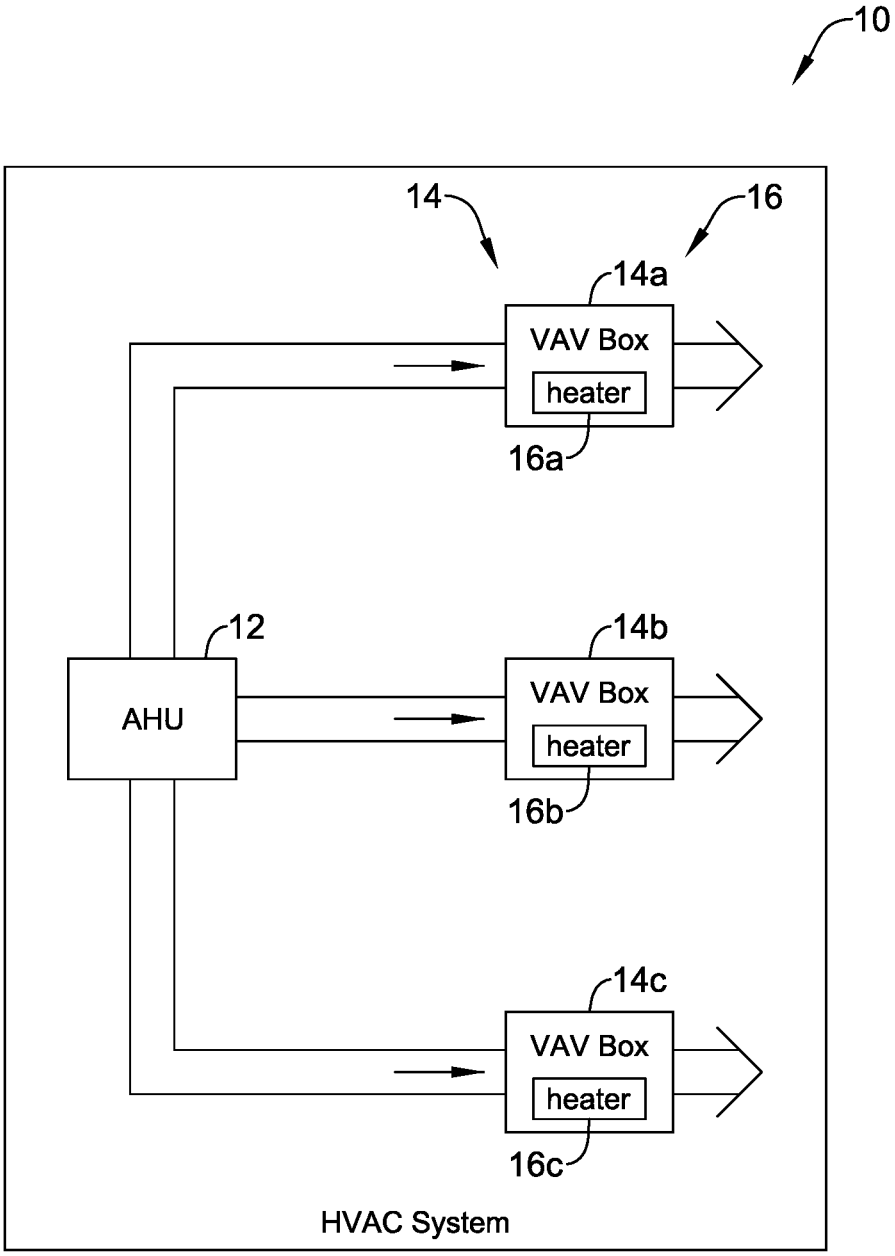
FIG. 1 is a schematic block diagram showing an illustrative HVAC system.

While the disclosure is amenable to various modifications and alternative forms, specifics thereof have been shown by way of example in the drawings and will be described in detail. It should be understood, however, that the intention is not to limit the disclosure to the particular examples described. On the contrary, the intention is to cover all modifications, equivalents, and alternatives falling within the spirit and scope of the disclosure.

DESCRIPTION

The following description should be read with reference to the drawings, in which like elements in different drawings are numbered in like fashion. The drawings, which are not necessarily to scale, depict examples that are not intended to limit the scope of the disclosure. Although examples are illustrated for the various elements, those skilled in the art will recognize that many of the examples provided have suitable alternatives that may be utilized.

All numbers are herein assumed to be modified by the term "about", unless the content clearly dictates otherwise. The recitation of numerical ranges by endpoints includes all numbers subsumed within that range (e.g., 1 to 5 includes 1, 1.5, 2, 2.75, 3, 3.80, 4, and 5).

As used in this specification and the appended claims, the singular forms "a", "an", and "the" include the plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is contemplated that the feature, structure, or characteristic is described in connection with an embodiment, it is contemplated that the feature, structure, or characteristic may be applied to other embodiments whether or not explicitly described unless clearly stated to the contrary.

FIG. 1 is a schematic block diagram showing an illustrative HVAC system 10. The illustrative HVAC system 10 includes an AHU (Air Handling Unit) 12. The AHU 12 may be configured to receive conditioned air from another source. In some instances, the AHU 12 may be configured to itself condition the air. Conditioning the air may refer to heating the air to increase its temperature, or cooling the air to decrease its temperature. Conditioning the air may refer to increasing or decreasing the relative humidity of the air, for example. Conditioning the air may refer to supplementing the air with fresh air from outside. The AHU 12 provides conditioned air to a number of VAV (Variable Air Volume) boxes 14, individually labeled as 14*a*, 14*b* and 14*c*. While the AHU 12 is shown as providing conditioned air to a total of three VAV boxes 14, this is merely illustrative. In some instances, the AHU 12 may provide conditioned air to a single VAV box 14 or to two VAV boxes 14. In some instances, the AHU 12 may provide conditioned air to four, five, six or more VAV boxes 14.

In some instances, each of the VAV boxes 14 may include a heater 16, individually labeled as 16*a*, 16*b* and 16*c*. In some instances, the heaters 16 may be used to affect a temperature increase in the air passing through the VAV box 14 and to the space. In some instances, the heaters 16 may not be actuated or otherwise used when the AHU 12 is providing heated air to each of the VAV boxes 14. In some instances, the AHU 12 may provide cooled air to each of the VAV boxes 14, and the cooled air may be cooled below a desired temperature setpoint in order to remove humidity from the air. In this circumstance, the heater 16 within each of the VAV boxes 14 may be used to increase the temperature of the cooled air to a temperature that is closer to, or at, the desired temperature setpoint. In some cases, only some of the VAV boxes may include a heater 16. In some cases, none of the VAV boxes may include a heater 16.

Figure 2:
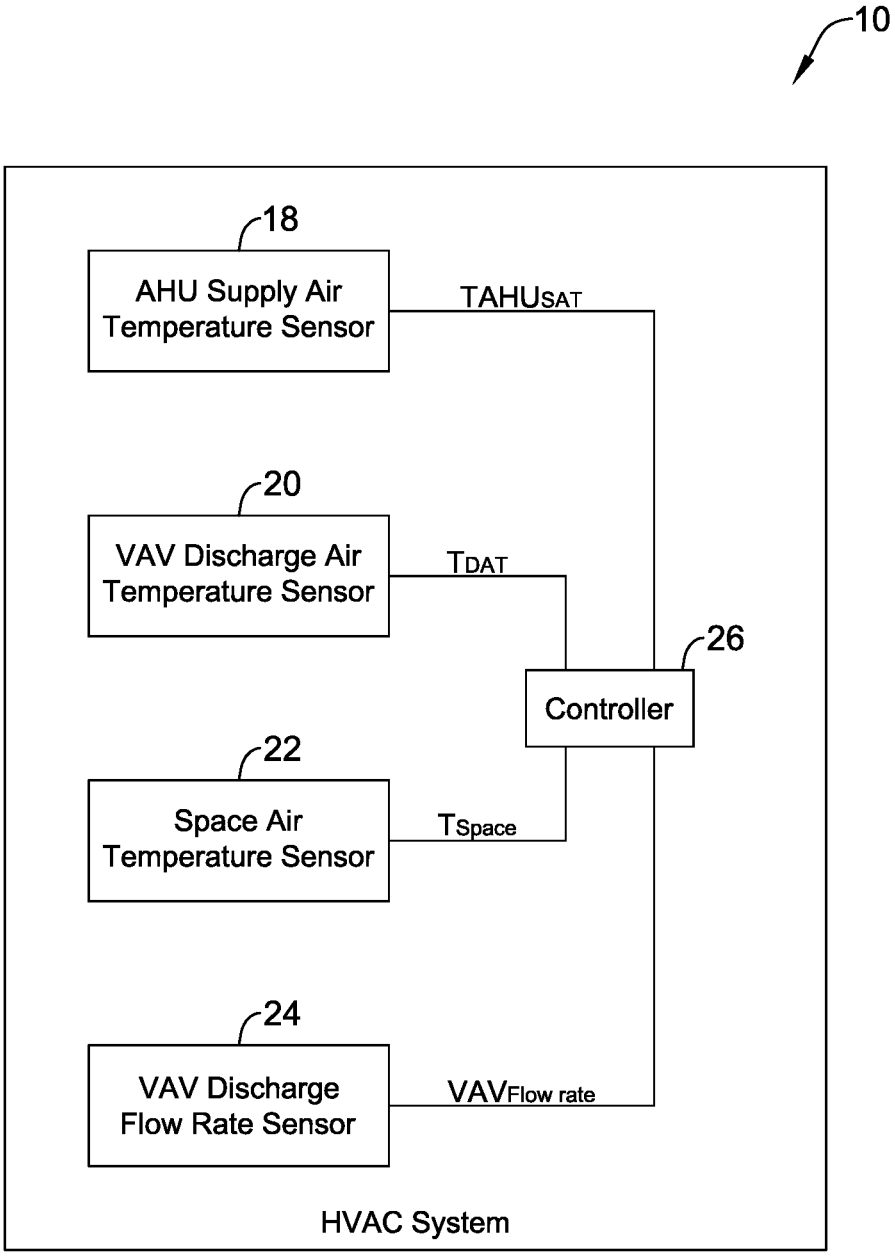
FIG. 2 is a schematic block diagram showing additional features of the illustrative HVAC system of FIG. 1.

FIG. 2 is a schematic block diagram showing additional features of the illustrative HVAC system 10. As seen in FIG. 2, the illustrative HVAC system 10 includes an AHU supply air temperature sensor 18 for providing an AHU supply air temperature ($TAHU_{SAT}$) that is representative of the temperature of the supply air that is received from the AHU 12 by the VAV box 14. The illustrative HVAC system 10 includes a VAV discharge air temperature sensor 20 for providing a VAV discharge air temperature ($T_{DAT}$) that is representative of the temperature of the VAV discharge air flow provided to the space by the VAV box 14. The illustrative HVAC system 10 includes a space air temperature sensor 22 for providing a space air temperature ($T_{SPACE}$) that is representative of the temperature of the air in the space. The illustrative HVAC system 10 includes a VAV discharge flow rate sensor 24 for providing a VAV discharge flow rate ($VAV_{FLOWRATE}$) that is representative of a flow rate of the VAV discharge air flow provided to the space by the VAV box 14. It is contemplated that the flow rate may be provided by a flow sensor, or may be derived from a fan speed or the like. In this example, a controller 26 is operatively coupled to the AHU supply air temperature sensor 18, the VAV discharge air temperature sensor 20, the space air temperature sensor 22 and the VAV discharge flow rate sensor 24.

Figure 3A:
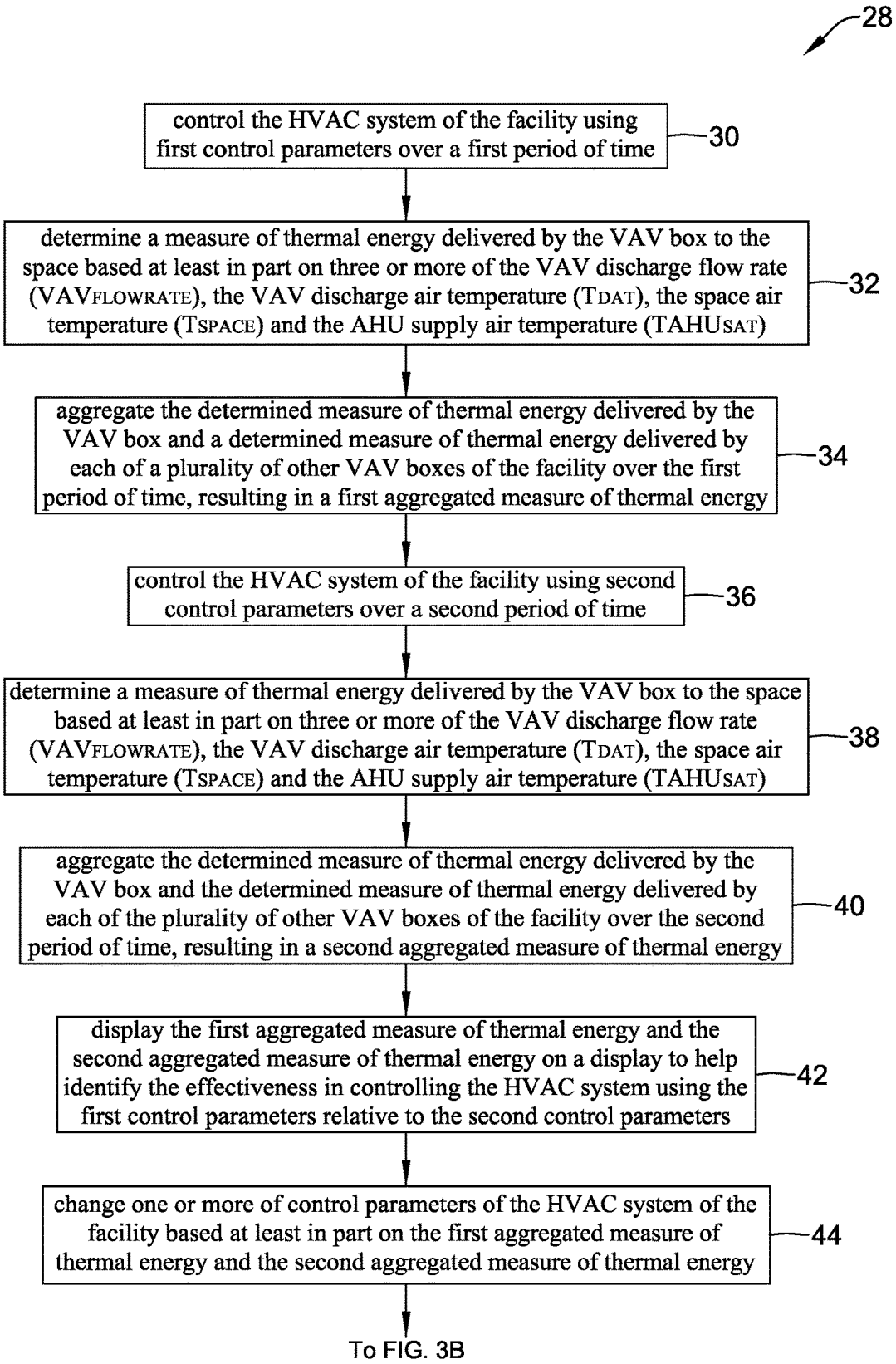
FIGS. 3A and 3B are flow diagrams that together show an illustrative series of steps that a controller forming part of the illustrative HVAC system of FIG. 1 may be configured to carry out.
Figure 3B:
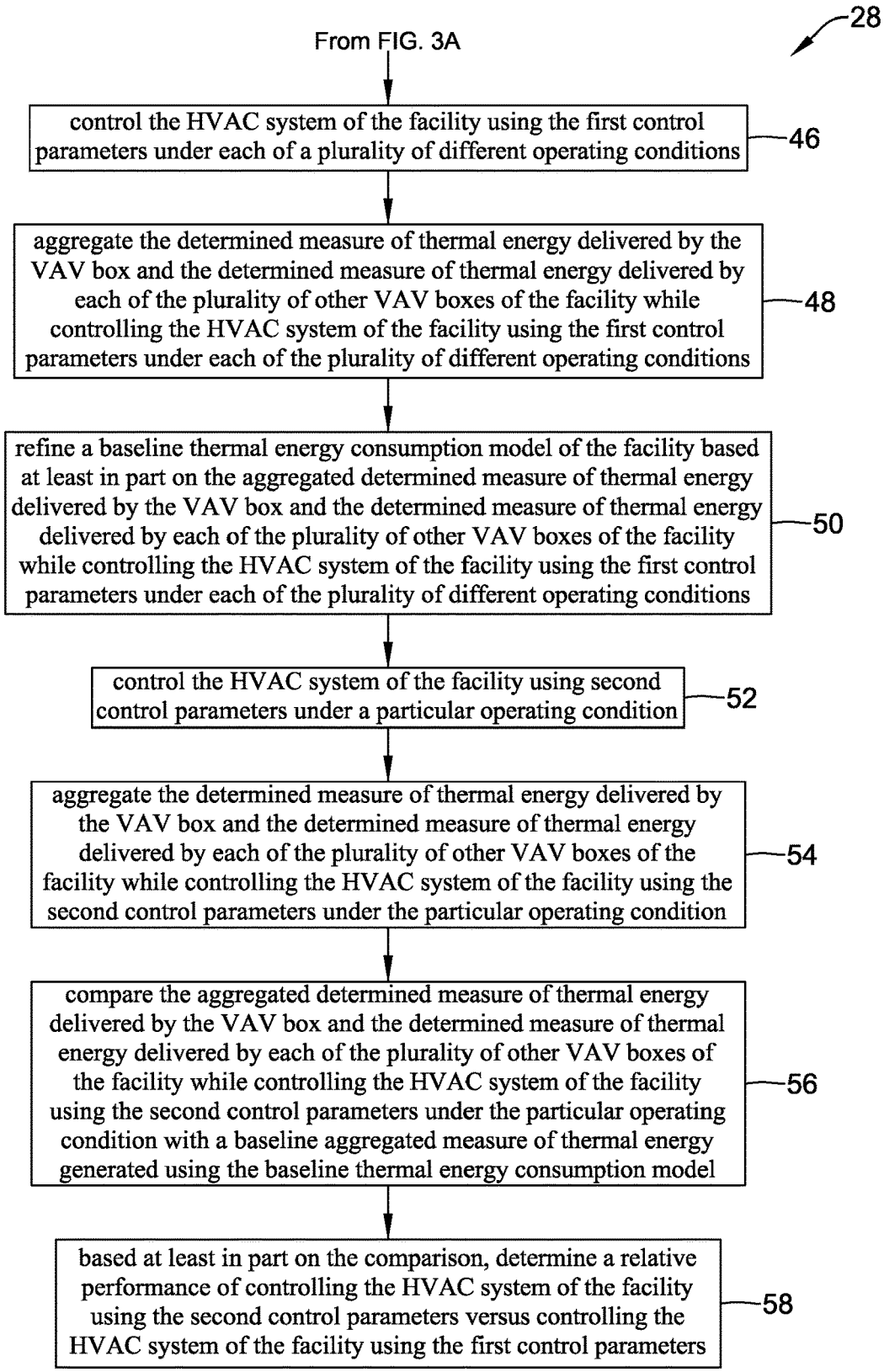

The controller 26 may be configured to carry out a number of different steps and functions. FIGS. 3A and 3B are flow diagrams that together show an illustrative series of steps 28 that the controller 26 may be configured to carry out. The controller 26 may be configured to control the HVAC system 10 of the facility using first control parameters over a first period of time, as indicated at block 30. The first control parameters may include temperature, humidity and/or other setpoints, setpoint schedules, outside ventilation rates, flow rates of various air streams (e.g. controlled by fan speeds), dead band parameters related to one or more setpoints, and/or any other suitable control parameters. While controlling the HVAC system 10 of the facility using the first control parameters over the first period of time, the controller 26 may be configured to determine a measure of thermal energy delivered by the VAV box to the space based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$), as indicated at block 32. The controller 26 may be configured to aggregate the determined measure of thermal energy delivered by the VAV box 14 and a determined measure of thermal energy delivered by each of a plurality of other VAV boxes of the facility (determined in the similar way) over the first period of time, resulting in a first aggregated measure of thermal energy, as indicated at block 34.

The controller 26 may be configured to control the HVAC system 10 of the facility using second control parameters over a second period of time, as indicated at block 36. The second control parameters may be different (e.g. different value) than the first control parameters. For example, a first control parameter may set a temperature setpoint to X degrees f, while a second control parameter may set the same temperature setpoint to Y degrees f, where Y degrees f is different from X degrees F. In another example, a first control parameter may set an outdoor ventilation rate to X percent, while a second control parameter may set the outdoor ventilation rate to Y percent, where Y percent is different from X percent. These are just examples. While controlling the HVAC system 10 of the facility using the second control parameters over the second period of time, the controller 26 may be configured to determine a measure of thermal energy delivered by the VAV box 14 to the space based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$), as indicated at block 38. The controller 26 may be configured to aggregate the determined measure of thermal energy delivered by the VAV box and the determined measure of thermal energy delivered by each of the plurality of other VAV boxes of the facility over the second period of time, resulting in a second aggregated measure of thermal energy, as indicated at block 40. The controller 26 may be configured to display the first aggregated measure of thermal energy and the second aggregated measure of thermal energy on a display to help identify the effectiveness in controlling the HVAC system using the first control parameters relative to the second control parameters, as indicated at block 42. In some cases, the controller 26 may be configured to compare the first aggregated measure of thermal energy and the second aggregated measure of thermal energy and display a measure of the comparison to help identify the effectiveness in controlling the HVAC system using the first control parameters relative to the second control parameters. The controller 26 may be configured to change one or more of control parameters of the HVAC system 10 of the facility based at least in part on the first aggregated measure of thermal energy and the second aggregated measure of thermal energy, as indicated at block 44.

Continuing on FIG. 3B, the controller 26 may be configured to control the HVAC system of the facility using the first control parameters under each of a plurality of different operating conditions, as indicated at block 46. The operating conditions may include, for example, different outdoor operating conditions (temperature, humidity, sun load, etc.), different indoor operating conditions (e.g. occupied, unoccupied, temperature, humidity), and/or any other suitable operating condition(s). The controller 26 may be configured to aggregate the determined measure of thermal energy delivered by the VAV box and the determined measure of thermal energy delivered by each of the plurality of other VAV boxes of the facility while controlling the HVAC system of the facility using the first control parameters under each of the plurality of different operating conditions, as indicated at block 48. The controller 26 may be configured to refine a baseline thermal energy consumption model of the facility based at least in part on the aggregated determined measure of thermal energy delivered by the VAV box and the determined measure of thermal energy delivered by each of the plurality of other VAV boxes of the facility while controlling the HVAC system of the facility using the first control parameters under each of the plurality of different operating conditions, as indicated at block 50.

Subsequently, and in some instances, the controller 26 may be configured to control the HVAC system 10 of the facility using second control parameters under a particular operating condition, as indicated at block 52. The controller 26 may be configured to aggregate the determined measure of thermal energy delivered by the VAV box 14 and the determined measure of thermal energy delivered by each of the plurality of other VAV boxes of the facility while controlling the HVAC system 10 of the facility using the second control parameters under the particular operating condition, as indicated at block 54. The controller 26 may be configured to compare the aggregated determined measure of thermal energy delivered by the VAV box and the determined measure of thermal energy delivered by each of the plurality of other VAV boxes of the facility while controlling the HVAC system of the facility using the second control parameters under the particular operating condition with a baseline aggregated measure of thermal energy generated using the baseline thermal energy consumption model (sometimes using the particular operating condition as an input to the baseline thermal energy consumption model), as indicated at block 56. Based at least in part on the comparison, the controller 26 may be configured to determine a relative performance of controlling the HVAC system of the facility using the second control parameters versus controlling the HVAC system of the facility using the first control parameters, as indicated at block 58.

In some instances, when the VAV discharge air temperature ($T_{DAT}$) is greater than the space air temperature ($T_{SPACE}$), the measure of thermal energy delivered by the VAV box 14 to the space when the HVAC system 10 is heating the space may be determined by:

$$\text{Thermal Energy Delivered} = VAV_{FLOWRATE} * Cp * (T_{DAT} - TAHU_{SAT})$$

where, Cp is the specific heat capacity of air.

When the VAV discharge air temperature ($T_{DAT}$) is less than or equal to the space air temperature ($T_{SPACE}$), the measure of thermal energy delivered by the VAV box 14 to the space when the HVAC system 10 is heating the space may be determined by:

$$\text{Thermal Energy Delivered} = 0.$$

In some instances, the VAV box 14 may include a VAV heater 16 that when activated adds sensible heat to the VAV discharge air flow to elevate the VAV discharge air temperature ($T_{DAT}$). When the VAV heater 16 is not activated, the measure of thermal energy delivered by the VAV box to the space when the HVAC system is cooling the space may be determined by:

$$\text{Thermal Energy Delivered} = VAV_{FLOWRATE} * Cp * (T_{SPACE} - TAHU_{SAT})$$

where, Cp is the specific heat capacity of air.

When the VAV heater 16 is activated, the measure of thermal energy delivered by the VAV box to the space when the HVAC system is cooling the space may be determined by:

$$\text{Thermal Energy Delivered} = VAV_{FLOWRATE} * Cp * (T_{DAT} - TAHU_{SAT}).$$

Figure 4:
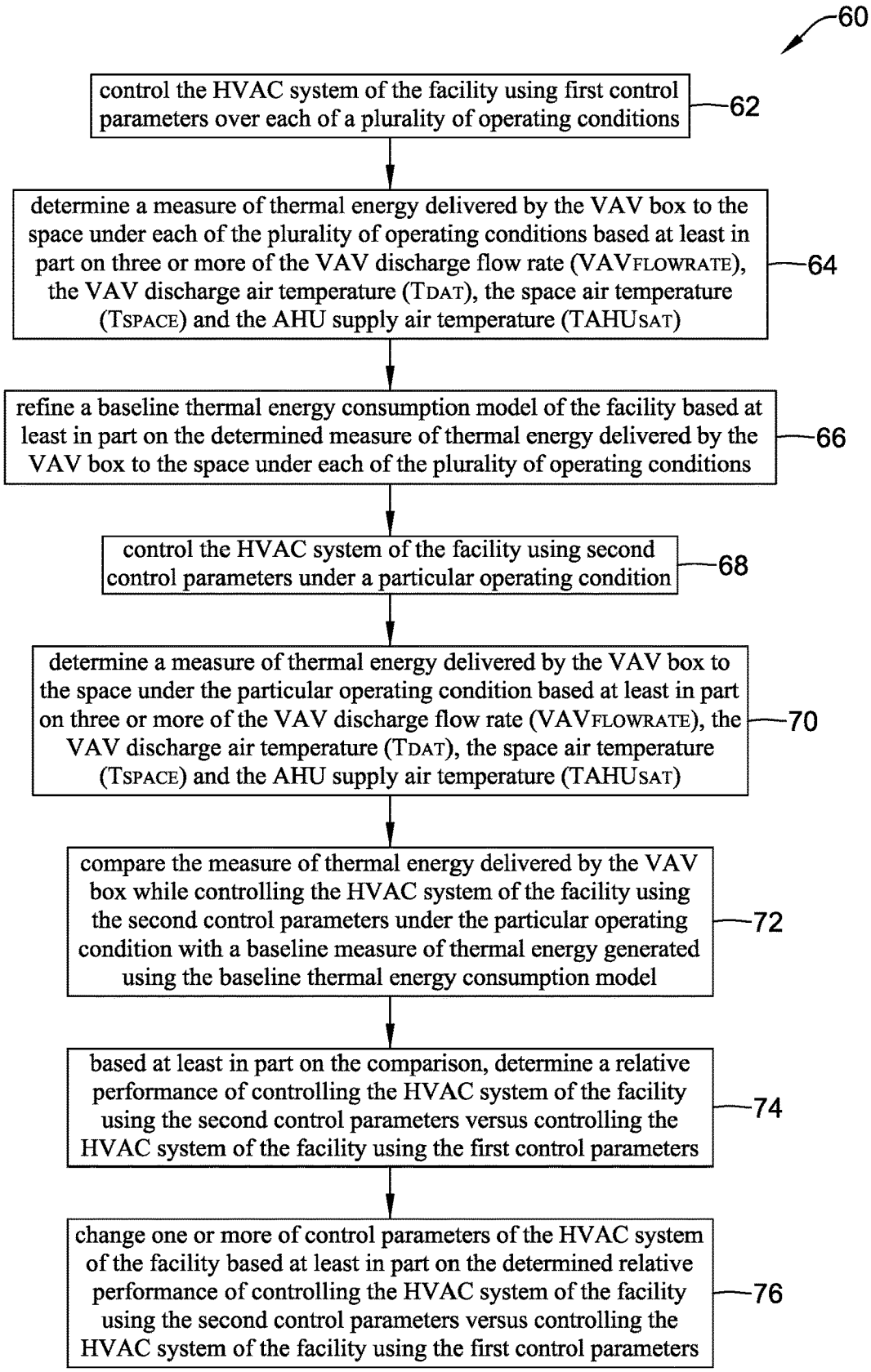
FIG. 4 is a flow diagram showing an illustrative series of steps that a controller forming part of the illustrative HVAC system of FIG. 1 may be configured to carry out.

FIG. 4 is a flow diagram showing an illustrative series of steps 60 that the controller 26 may be configured to carry out. In some instances, the controller 26 may be configured to control the HVAC system 10 of the facility using first control parameters over each of a plurality of operating conditions, as indicated at block 62. The controller 26 may be configured to determine a measure of thermal energy delivered by the VAV box 14 to the space under each of the plurality of operating conditions based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$), as indicated at block 64. The controller 26 may be configured to refine a baseline thermal energy consumption model of the facility based at least in part on the determined measure of thermal energy delivered by the VAV box 14 to the space under each of the plurality of operating conditions, as indicated at block 66.

The controller 26 may be configured to control the HVAC system 10 of the facility using second control parameters under a particular operating condition, as indicated at block 68. The controller 26 may be configured to determine a measure of thermal energy delivered by the VAV box 14 to the space under the particular operating condition based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$), as indicated at block 70. The controller 26 may be configured to compare the measure of thermal energy delivered by the VAV box 14 while controlling the HVAC system 10 of the facility using the second control parameters under the particular operating condition with a baseline measure of thermal energy generated using the baseline thermal energy consumption model (sometimes using the particular operating condition as an input to the baseline thermal energy consumption model), as indicated at block 72. Based at least in part on the comparison, the controller 26 may be configured to determine a relative performance of controlling the HVAC system 10 of the facility using the second control parameters versus controlling the HVAC system 10 of the facility using the first control parameters, as indicated at block 74. In some instances, the controller 26 may be configured to change one or more of control parameters of the HVAC system 10 of the facility based at least in part on the determined relative performance of controlling the HVAC system 10 of the facility using the second control parameters versus controlling the HVAC system 10 of the facility using the first control parameters, as indicated at block 76.

Figure 5:
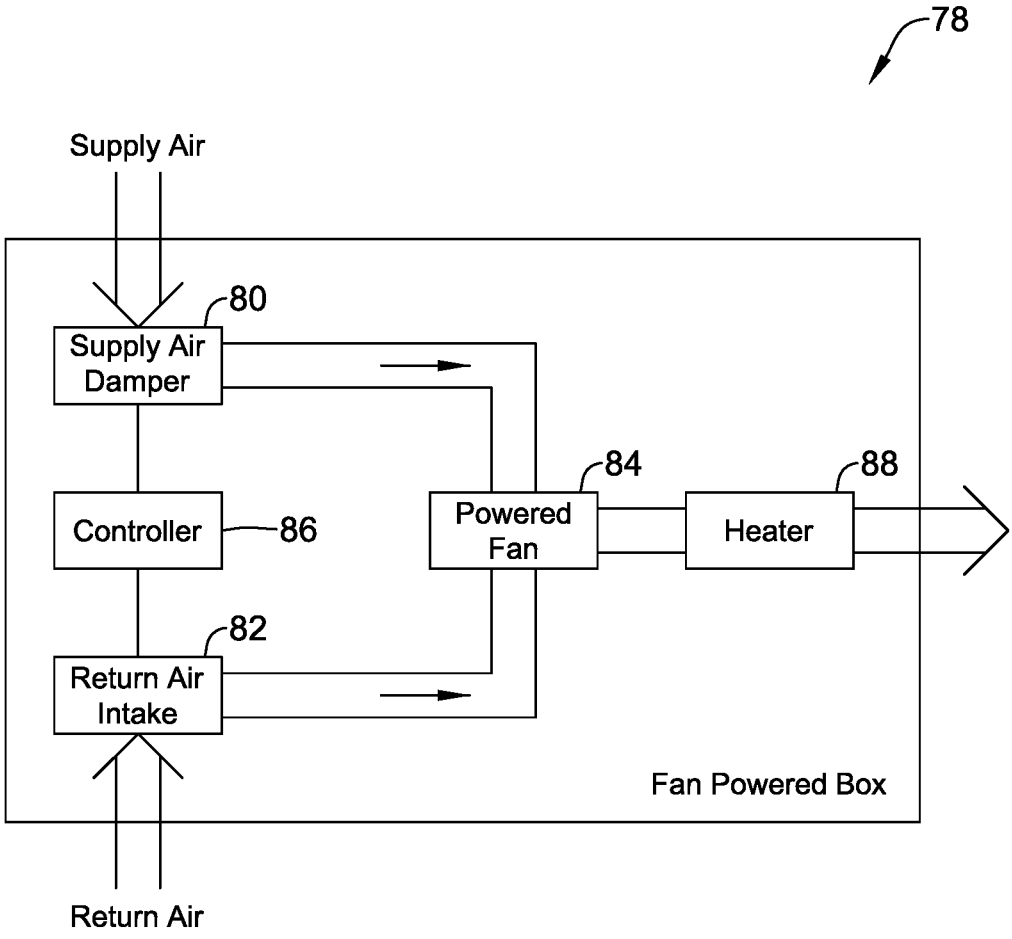
FIG. 5 is a schematic block diagram showing an illustrative FPB (Fan Powered Box)

FIG. 5 is a schematic block diagram showing an illustrative Fan Powered VAV Box (FPB) 78, which may be considered as a particular type of VAV box 14. The illustrative FPB 78 includes a supply air damper 80 for regulating a flow rate of the supply air ($VAVsupply_{FLOWRATE}$) that is received from the AHU 12. The FPB 78 includes a return air intake 82 for receiving a flow of return air ($VAVreturn_{FLOWRATE}$) from the space, wherein the VAV discharge flow rate ($VAV_{FLOWRATE}$) is the sum of the $VAVsupply_{FLOWRATE}$ and the $VAVreturn_{FLOWRATE}$. The FPB 78 includes a powered fan 84. A controller 86 is configured to regulate the supply air damper 80 and the powered fan 84 in order to achieve a desired ratio of supply air received from the AHU 12 and return air from the space via the return air intake 82. In some instances, the FPB 78 also includes a heater 88.

Figure 6A:
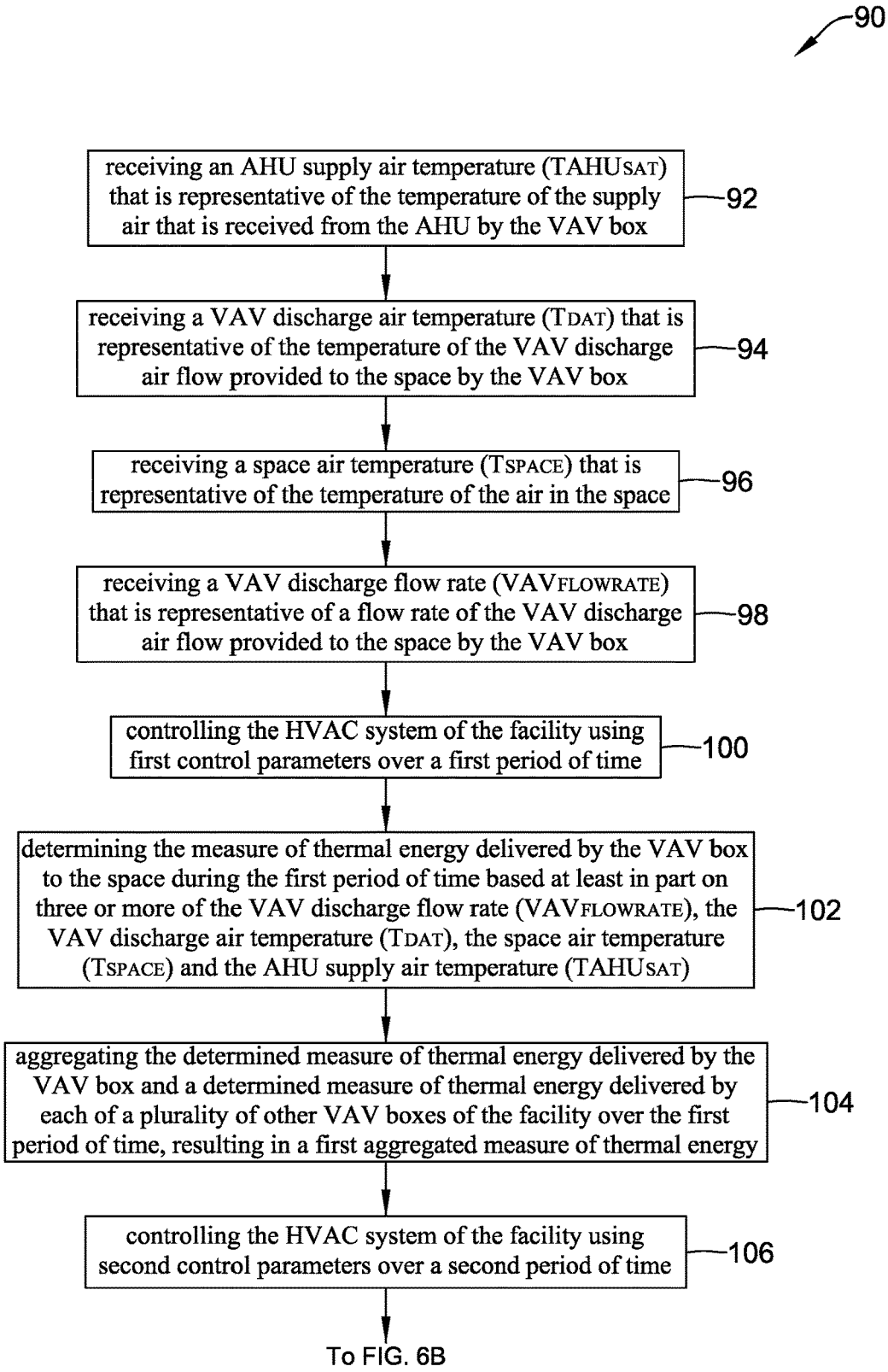
FIGS. 6A and 6B are flow diagrams that together show an illustrative method for determining a measure of thermal energy delivered by a VAV box.
Figure 6B:
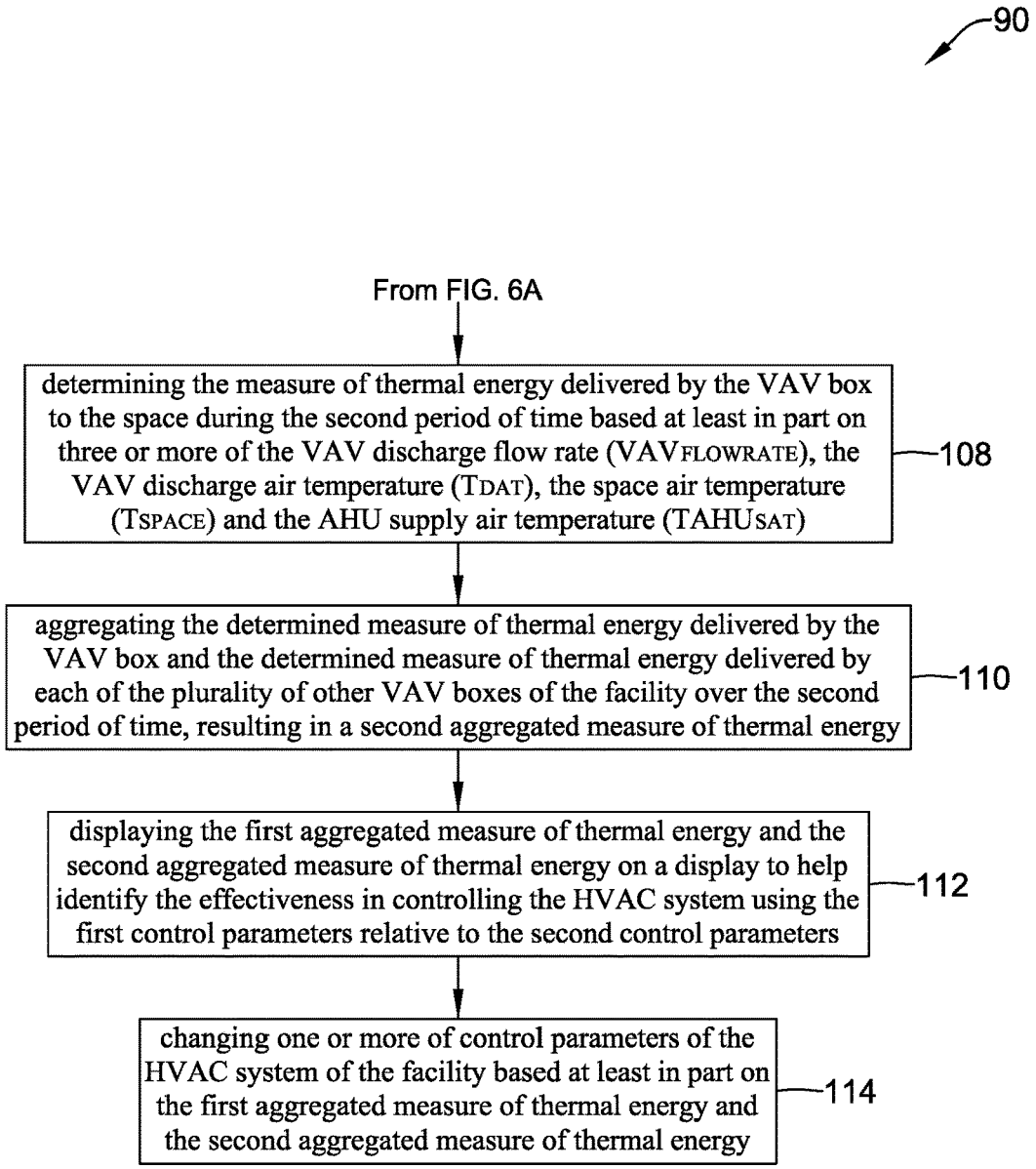

FIGS. 6A and 6B are flow diagrams that together show an illustrative method 90 for determining a measure of thermal energy delivered via a VAV box (such as the VAV box 14) to a space of a facility. The VAV box receiving a supply air from an AHU (such as the AHU 12) of an HVAC system (such as the HVAC system 10) and providing a VAV discharge air flow to the space of the facility. The illustrative method 90 includes receiving an AHU supply air temperature ($TAHU_{SAT}$) that is representative of the temperature of the supply air that is received from the AHU by the VAV box, as indicated at block 92. The method 90 includes receiving a VAV discharge air temperature ($T_{DAT}$) that is representative of the temperature of the VAV discharge air flow provided to the space by the VAV box, as indicated at block 94. The method 90 includes receiving a space air temperature ($T_{SPACE}$) that is representative of the temperature of the air in the space, as indicated at block 96. The method 90 includes receiving a VAV discharge flow rate ($VAV_{FLOWRATE}$) that is representative of a flow rate of the VAV discharge air flow provided to the space by the VAV box, as indicated at block 98. The HVAC system of the facility is controlled using first control parameters over a first period of time, as indicated at block 100.

The measure of thermal energy delivered by the VAV box to the space during the first period of time is determined based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$), as indicated at block 102. The determined measure of thermal energy delivered by the VAV box and a determined measure of thermal energy delivered by each of a plurality of other VAV boxes of the facility (determined in the same way) is aggregated over the first period of time, resulting in a first aggregated measure of thermal energy, as indicated at block 104. The HVAC system of the facility is controlled using second control parameters over a second period of time, as indicated at block 106.

Continuing on FIG. 6B, the illustrative method 90 includes determining the measure of thermal energy delivered by the VAV box to the space during the second period of time based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$), as indicated at block 108. The determined measure of thermal energy delivered by the VAV box and the determined measure of thermal energy delivered by each of the plurality of other VAV boxes of the facility is aggregated over the second period of time, resulting in a second aggregated measure of thermal energy, as indicated at block 110. The first aggregated measure of thermal energy and the second aggregated measure of thermal energy are displayed on a display to help identify the effectiveness in controlling the HVAC system using the first control parameters relative to the second control parameters, as indicated at block 112. In some instances, the method 90 may include changing one or more of control parameters of the HVAC system of the facility based at least in part on the first aggregated measure of thermal energy and the second aggregated measure of thermal energy, as indicated at block 114.

Figure 7A:
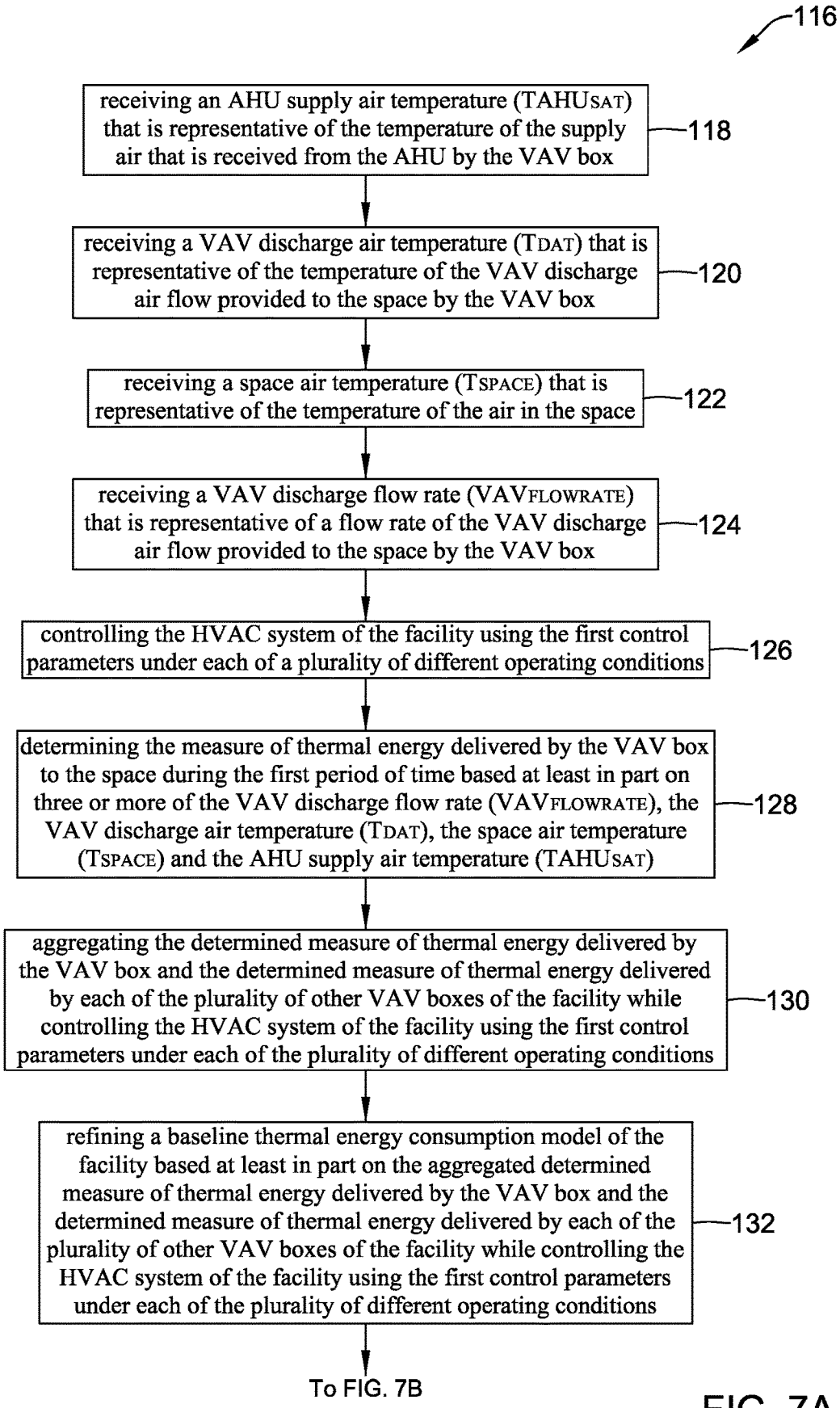
FIGS. 7A and 7B are flow diagrams that together show an illustrative method for determining a measure of thermal energy delivered by a VAV box.
Figure 7B:
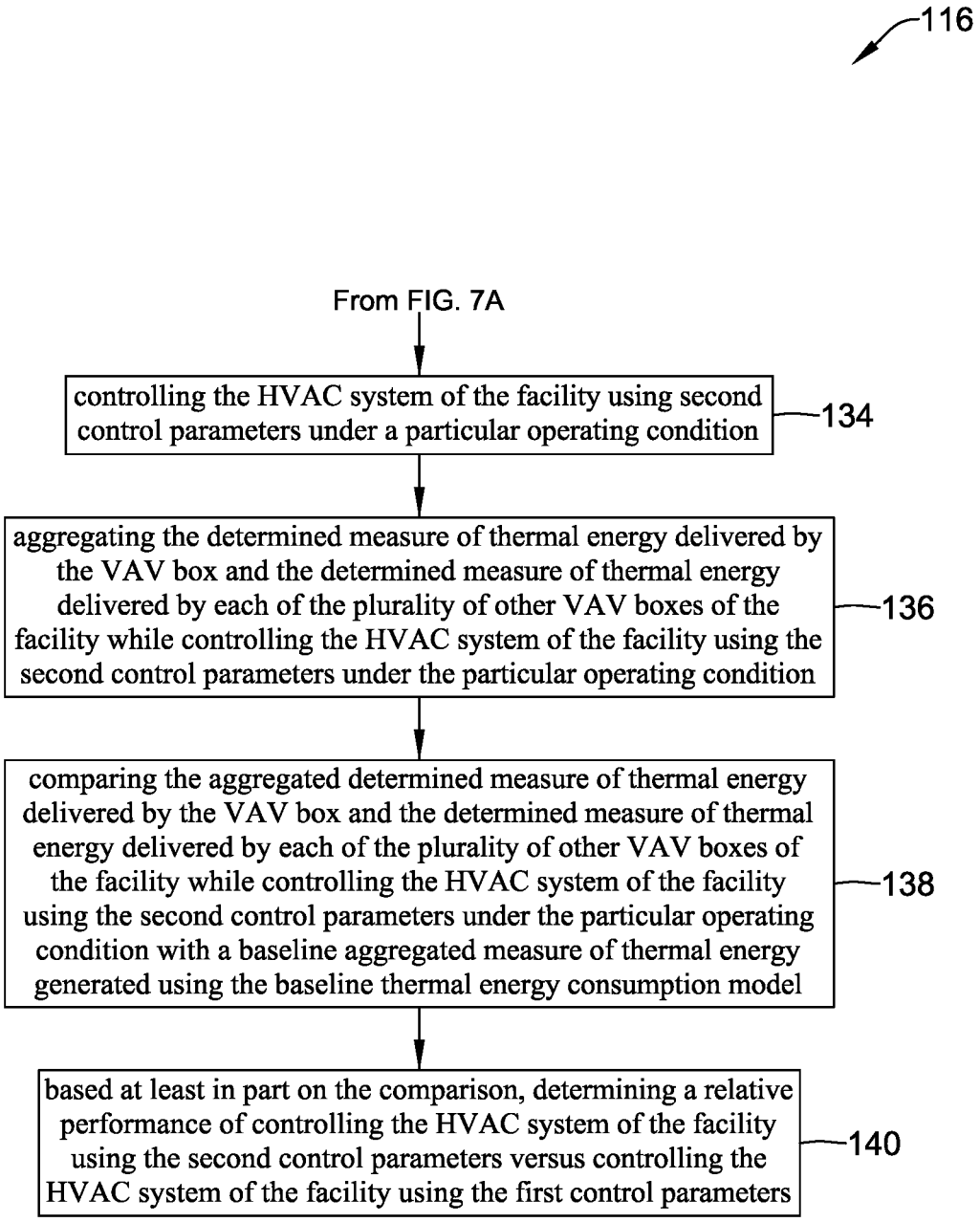

FIGS. 7A and 7B are flow diagrams that together show an illustrative method 116 for determining a measure of thermal energy delivered via a VAV box (such as the VAV box 14) to a space of a facility. The VAV box receiving a supply air from an AHU (such as the AHU 12) of an HVAC system (such as the HVAC system 10) and providing a VAV discharge air flow to the space of the facility. The illustrative method 116 includes receiving an AHU supply air temperature ($TAHU_{SAT}$) that is representative of the temperature of the supply air that is received from the AHU by the VAV box, as indicated at block 118. The method 116 includes receiving a VAV discharge air temperature ($T_{DAT}$) that is representative of the temperature of the VAV discharge air flow provided to the space by the VAV box, as indicated at block 120. The method 116 includes receiving a space air temperature ($T_{SPACE}$) that is representative of the temperature of the air in the space, as indicated at block 122. The method 116 includes receiving a VAV discharge flow rate ($VAV_{FLOWRATE}$) that is representative of a flow rate of the VAV discharge air flow provided to the space by the VAV box, as indicated at block 124. The HVAC system of the facility is controlled using first control parameters under each of a plurality of different operating conditions, as indicated at block 126.

The measure of thermal energy delivered by the VAV box to the space during the first period of time is determined based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$), as indicated at block 128. The determined measure of thermal energy delivered by the VAV box and the determined measure of thermal energy delivered by each of the plurality of other VAV boxes of the facility while controlling the HVAC system of the facility using the first control parameters are aggregated under each of the plurality of different operating conditions, as indicated at block 130. A baseline thermal energy consumption model of the facility is refined based at least in part on the aggregated determined measure of thermal energy delivered by the VAV box and the determined measure of thermal energy delivered by each of the plurality of other VAV boxes of the facility while controlling the HVAC system of the facility using the first control parameters under each of the plurality of different operating conditions, as indicated at block 132.

Continuing on FIG. 7B, the illustrative method 116 includes controlling the HVAC system of the facility using second control parameters under a particular operating condition, as indicated at block 134. The determined measure of thermal energy delivered by the VAV box and the determined measure of thermal energy delivered by each of the plurality of other VAV boxes of the facility while controlling the HVAC system of the facility using the second control parameters under the particular operating condition are aggregated, as indicated at block 136. The aggregated determined measure of thermal energy delivered by the VAV box and the determined measure of thermal energy delivered by each of the plurality of other VAV boxes of the facility while controlling the HVAC system of the facility using the second control parameters under the particular operating condition are compared with a baseline aggregated measure of thermal energy generated using the baseline thermal energy consumption model (sometimes using the particular operating condition as an input to the baseline thermal energy consumption model), as indicated at block 138. The method 116 includes, based at least in part on the comparison, determining a relative performance of controlling the HVAC system of the facility using the second control parameters versus controlling the HVAC system of the facility using the first control parameters, as indicated at block 140.

Figure 8:
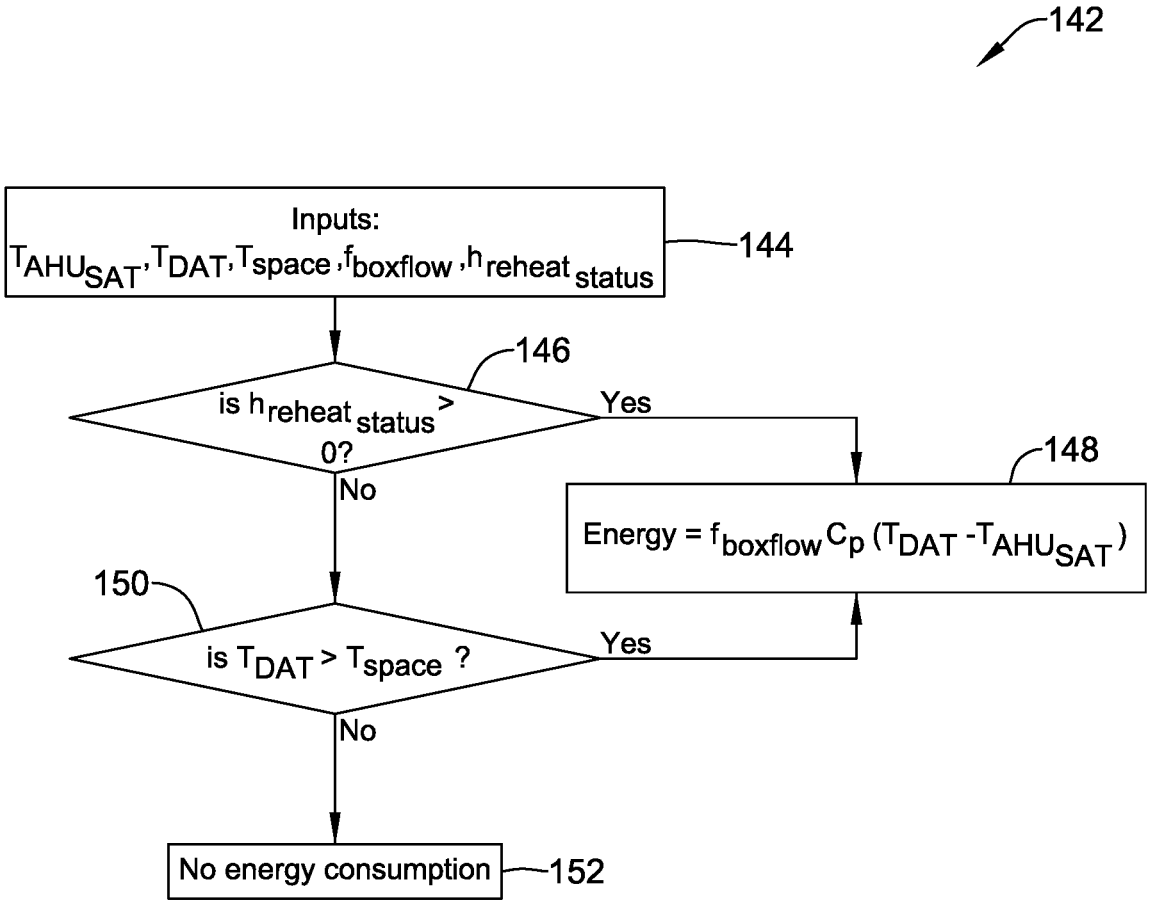
FIG. 8 is a flow diagram showing an illustrative method for determining energy consumption in a VAV box with reheat under a heating scenario.

FIG. 8 is a flow diagram showing an illustrative method 142 of determining energy consumption in a VAV box with reheat under a heating scenario. The method 142 begins with several inputted values, as indicated at block 144. At a decision block 146, a determination is made as to whether the heater reheat status is greater than zero. For electrical heaters, the heater reheat status is set equal to zero if the heaters are disabled and is set equal to 1 if the heaters are enabled. For analog heaters, such as those using hot water, the heater reheat status is set equal to 0 if a reheater valve is closed (no hot water flow) and is set equal to 1 if the reheater valve is open (hot water is allowed to flow). If the heater reheat status is greater than zero, control passes to block 148 and the measure of thermal energy delivered by the VAV box to the space when the HVAC system is heating the space is determined by:

$$\text{Thermal Energy Delivered} = VAV_{FLOWRATE} * Cp * (T_{DAT} - TAHU_{SAT})$$

where, Cp is the specific heat capacity of air.

When the heater reheat status is not greater than zero, control passes to a decision block 150, where a determination is made as to whether the VAV discharge temperature ($T_{DAT}$) is greater than the space temperature ($T_{SPACE}$) (i.e. heating). If yes, control passes to block 148 and the measure of thermal energy delivered by the VAV box to the space when the HVAC system is heating the space is determined by the equation provided. However, when the VAV discharge air temperature ($T_{DAT}$) is less than or equal to the space air temperature ($T_{SPACE}$) (i.e. not heating), control passes to block 152 and the measure of thermal energy delivered by the VAV box to the space when the HVAC system is heating the space is determined by:

$$\text{Thermal Energy Delivered} = 0.$$

Figure 9:
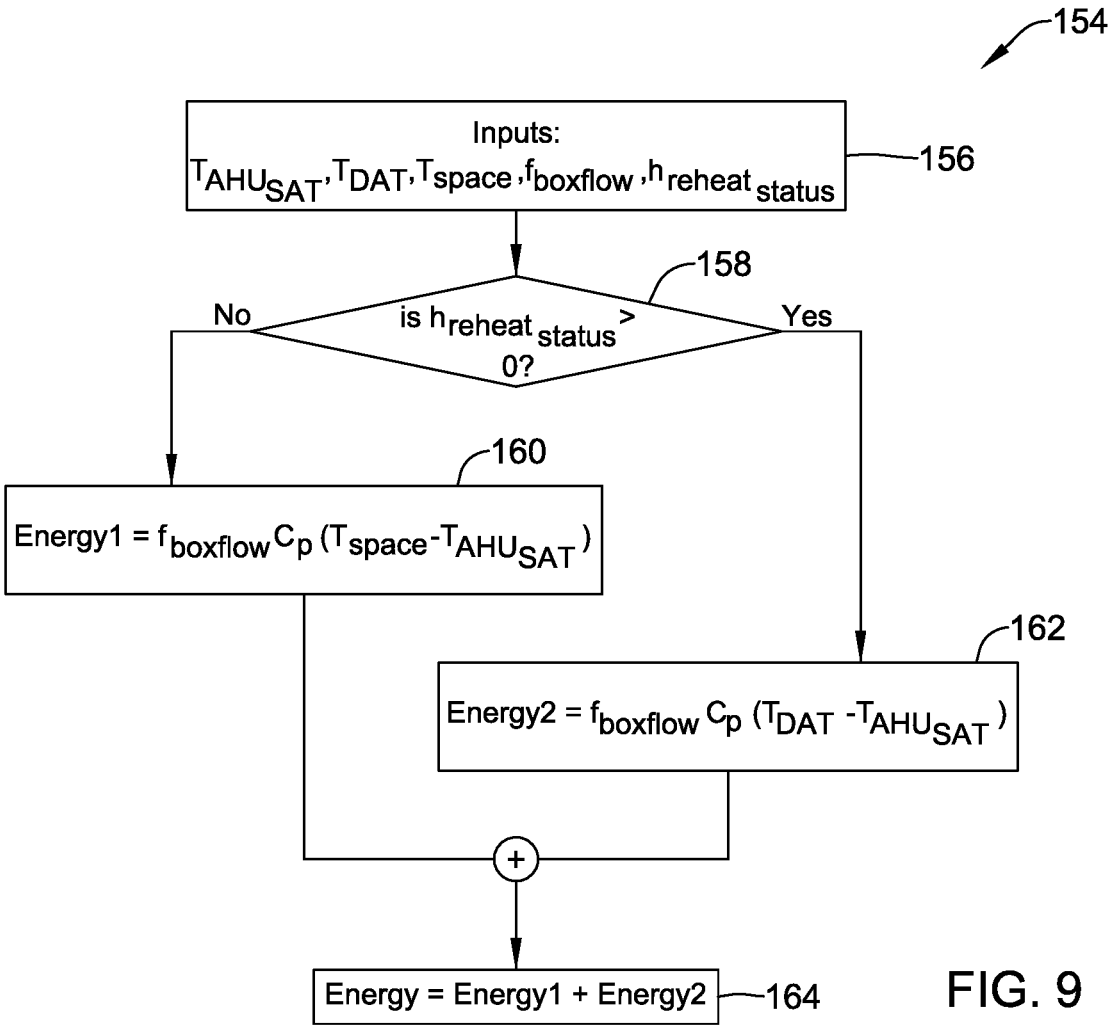
FIG. 9 is a flow diagram showing an illustrative method for determining energy consumption in a VAV box with reheat under a cooling scenario.

FIG. 9 is a flow diagram showing an illustrative method 142 of determining energy consumption in a VAV box with reheat under a cooling scenario. In some instances, the VAV box 14 may include a VAV heater 16 that when activated adds sensible heat to the VAV discharge air flow to elevate the VAV discharge air temperature ($T_{DAT}$). The method 142 begins with several inputs, as indicated at block 156. At a decision block 158, a determination is made as to whether the VAV heater has been activated in the cooling scenario. If not, control passes to block 160, where the measure of thermal energy delivered by the VAV box to the space when the HVAC system is cooling the space is determined by:

$$\text{Thermal Energy Delivered} = VAV_{FLOWRATE} * Cp * (T_{SPACE} - TAHU_{SAT})$$

where, Cp is the specific heat capacity of air.

Here, the energy delivered to the space comes from the AHU.

When the VAV heater has been activated in the cooling scenario, control passes to block 162, where the measure of thermal energy delivered by the VAV box to the space when the HVAC system is cooling the space is determined by:

$$\text{Thermal Energy Delivered} = VAV_{FLOWRATE} * Cp * (T_{DAT} - TAHU_{SAT}).$$

At block 164, the energy calculated at block 160 is added to the energy calculated at block 162 in order to determine a total energy value over a period of time. At any given time, either the reheat will be on or off, but not both. That is, in some instances, the VAV heater is activated and deactivated over a period of time, wherein the measure of thermal energy delivered by the VAV box to the space over the period of time when the HVAC system is cooling the space is determining by summing the thermal energy delivered during the times that the VAV heater was not activated and the thermal energy delivered during the times that the VAV heater was activated.

Figure 10:
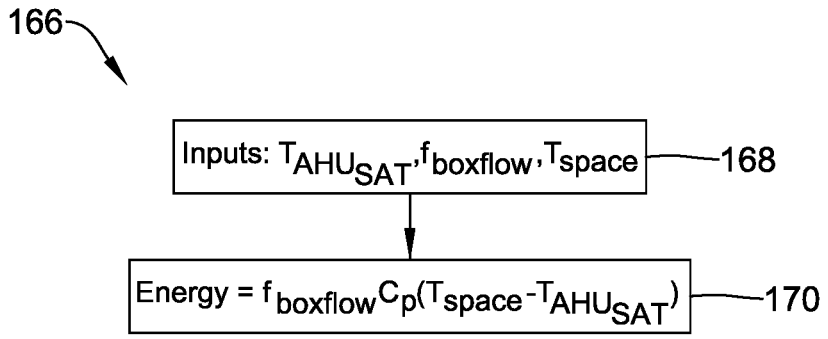
FIG. 10 is a flow diagram showing an illustrative method for determining energy consumption in a VAV box without reheat in a cooling scenario.

FIG. 10 is a flow diagram showing an illustrative method 166 of determining energy consumption in a VAV box under a cooling scenario, with no VAV reheat. The method 166 begins with several inputs, as indicated at block 168. The measure of thermal energy delivered by the VAV box (from the AHU) to the space when the HVAC system is cooling the space is determined by:

$$\text{Thermal Energy Delivered} = VAV_{FLOWRATE} * Cp * (T_{SPACE} - TAHU_{SAT}),$$

as indicated at block 170.

Figure 11:
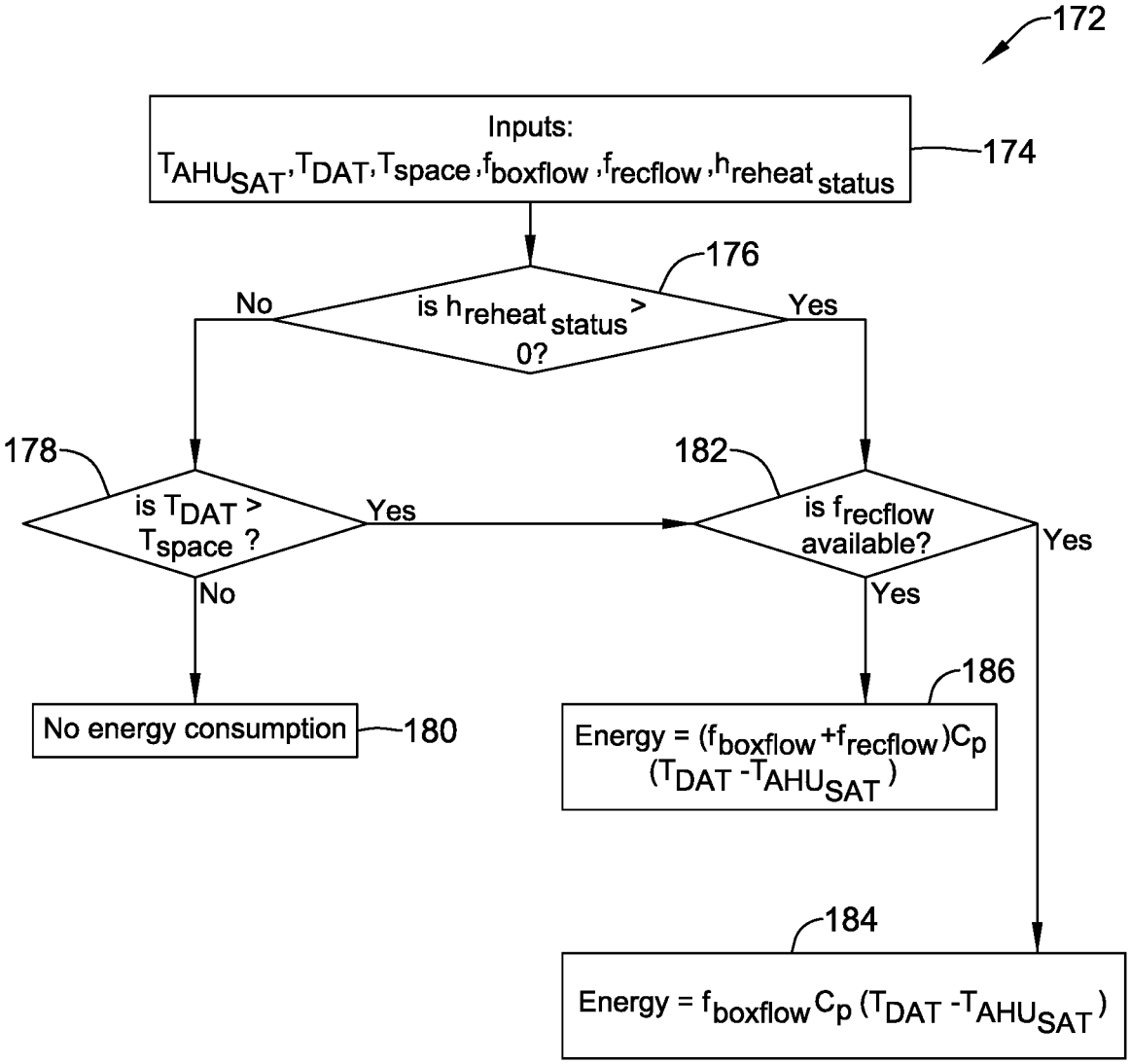
FIG. 11 is a flow diagram showing an illustrative method for determining energy consumption in a FPB under a heating scenario.

FIG. 11 is a flow diagram showing an illustrative method 172 of determining energy consumption in a PFB under a heating scenario. The method 172 begins with several inputs, as indicated at block 174. Control passes to a decision block 176, where a determination is made as to whether the heater reheat status is greater than zero. If not, control passes to a decision block 178 where a determination is made as to whether the VAV discharge air temperature ($T_{DAT}$) is greater than the space air temperature ($T_{SPACE}$). If not, control passes to block 180, where the measure of thermal energy delivered by the VAV box to the space is determined by:

$$\text{Thermal Energy Delivered} = 0.$$

However, if the heater reheat status is greater zero, or if the VAV discharge air temperature ($T_{DAT}$) is greater than the space air temperature ($T_{SPACE}$), control passes to a decision block 182, where a determination is made as to whether the $VAVreturn_{FLOWRATE}$ is available. If no, control passes to block 184 and the measure of thermal energy delivered by the VAV box to the space is determined by:

$$\text{Thermal Energy Delivered} = VAVsupplyflowrate * Cp * (T_{DAT} - TAHU_{SAT}),$$

where Cp is the specific heat capacity of air. However, if the $VAVreturn_{FLOWRATE}$ is available, control passes to block 186, where a more accurate measure of thermal energy delivered by the VAV box to the space is determined by:

$$\text{Thermal Energy Delivered} = (VAVsupplyflowrate + VAVreturnflowrate) * Cp * (T_{DAT} - TAHU_{SAT}).$$

Figure 12:
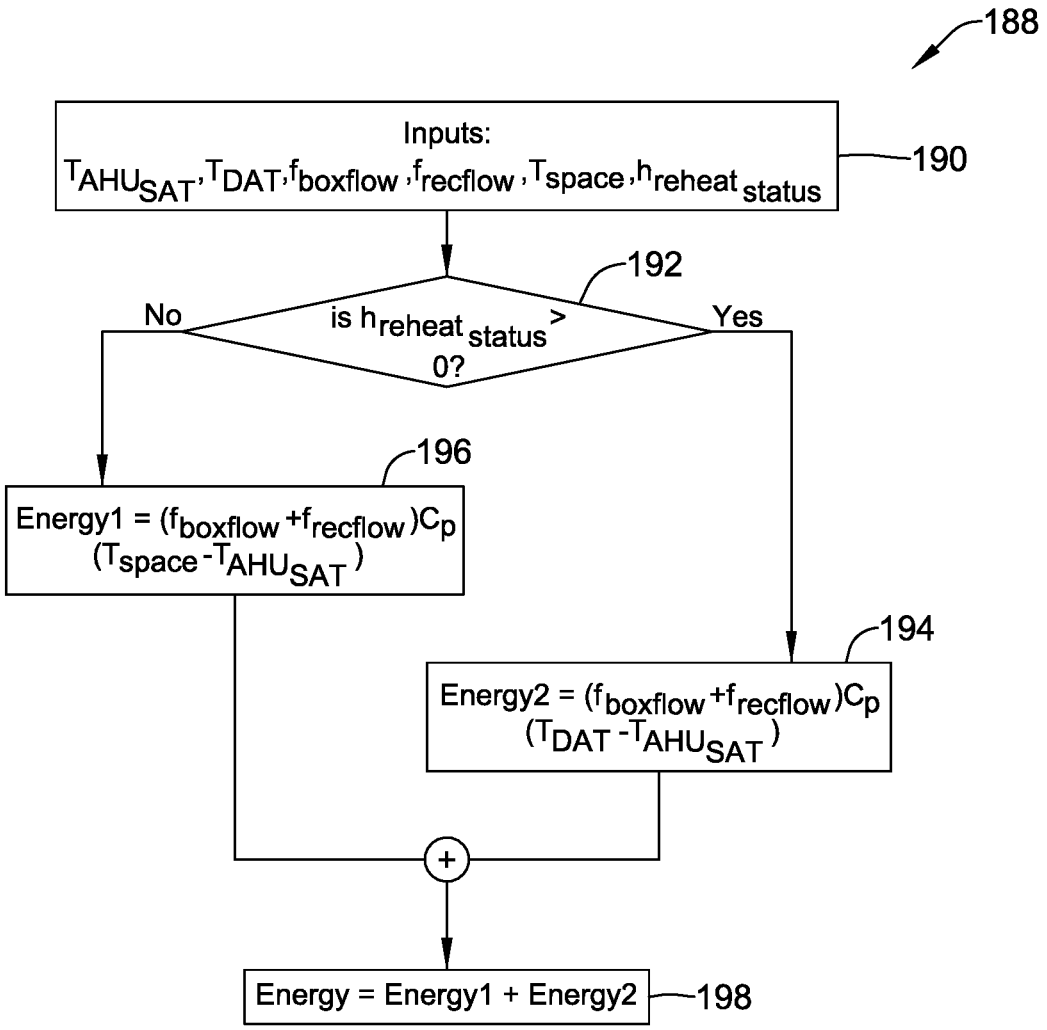
FIG. 12 is a flow diagram showing an illustrative method for determining energy consumption in a FPB under a cooling scenario.

FIG. 12 is a flow diagram showing an illustrative method 188 of determining energy consumption in a PFB under a cooling scenario. The method 188 begins with several inputs, as indicated at block 190. At a decision block 192, a determination is made as to whether the heater reheat status is greater than zero. If yes, control passes to block 194 and the measure of thermal energy delivered by the VAV box to the space is determined by:

$$\text{Thermal Energy Delivered} = VAV_{FLOWRATE} * Cp * (T_{DAT} - TAHU_{SAT}),$$

where Cp is the specific heat capacity of air.

If no, control passes to block 196 and the measure of thermal energy delivered by the VAV box to the space is determined by:

$$\text{Thermal Energy Delivered} = (VAVsupplyflowrate + VAVreturnflowrate) * Cp * (T_{DAT} - TAHU_{SAT}).$$

At block 198, the energy calculated at block 194 is added to the energy calculated at block 196 in order to determine a total energy value.

In some instances, the energy values calculated as shown for example in FIGS. 8 through 12 may be used in determining the benefits of operating the HVAC system 10 in accordance with any of a variety of different energy conservation algorithms. In some instances, the HVAC system 10 may be operated in accordance with any of a comfort algorithm, an energy savings algorithm or a health algorithm. Each of these algorithms may take a different relative position on comfort versus energy consumption, or air quality versus energy consumption, for example. Each algorithm may utilize, for example, differing relative amounts of fresh outdoor air. Each algorithm may utilize differing temperature setpoints. A comfort algorithm may have a heating setpoint of 72° F. and a cooling setpoint of 78° F. while an energy saving algorithm may have a heating setpoint of 68° F. and a cooling setpoint of 82° F. These are just examples. In some instances, there may be a desire to be able to determine and display the energy savings generated using a particular operating algorithm. In some cases, a baseline model may be used to represent energy consumption without any energy savings being implemented, and then a relative energy consumption of each algorithm may be determined. Depending on the results, the particular control parameters of a particular control algorithm may be adjusted to achieve a desired balance of energy consumption versus comfort, energy and/or health.

Having thus described several illustrative embodiments of the present disclosure, those of skill in the art will readily appreciate that yet other embodiments may be made and used within the scope of the claims hereto attached. It will be understood, however, that this disclosure is, in many respects, only illustrative. Changes may be made in details, particularly in matters of shape, size, arrangement of parts, and exclusion and order of steps, without exceeding the scope of the disclosure. The disclosure's scope is, of course, defined in the language in which the appended claims are expressed.

What is claimed is:

1. A method for determining a measure of thermal energy delivered via a Variable Air Volume (VAV) box to a space of a facility, the VAV box receiving a supply air from an Air Handler Unit (AHU) of a Heating, Ventilating and/or Air Conditioning (HVAC) system of the facility and providing a VAV discharge air flow to the space of the facility, the method comprising:

receiving an AHU supply air temperature ($TAHU_{SAT}$) that is representative of the temperature of the supply air that is received from the AHU by the VAV box;

receiving a VAV discharge air temperature ($T_{DAT}$) that is representative of the temperature of the VAV discharge air flow provided to the space by the VAV box;

receiving a space air temperature ($T_{SPACE}$) that is representative of the temperature of the air in the space;

receiving a VAV discharge flow rate ($VAV_{FLOWRATE}$) that is representative of a flow rate of the VAV discharge air flow provided to the space by the VAV box;

controlling the HVAC system of the facility using first control parameters over a first period of time;

determining the measure of thermal energy delivered by the VAV box to the space during the first period of time based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$);

aggregating the determined measure of thermal energy delivered by the VAV box and a determined measure of thermal energy delivered by each of a plurality of other VAV boxes of the facility over the first period of time, resulting in a first aggregated measure of thermal energy;

controlling the HVAC system of the facility using second control parameters over a second period of time;

determining the measure of thermal energy delivered by the VAV box to the space during the second period of time based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$);

aggregating the determined measure of thermal energy delivered by the VAV box and the determined measure of thermal energy delivered by each of the plurality of other VAV boxes of the facility over the second period of time, resulting in a second aggregated measure of thermal energy; and displaying the first aggregated measure of thermal energy and the second aggregated measure of thermal energy on a display to help identify the effectiveness in controlling the HVAC system using the first control parameters relative to the second control parameters.

2. The method of claim 1, further comprising:

changing one or more of control parameters of the HVAC system of the facility based at least in part on the first aggregated measure of thermal energy and the second aggregated measure of thermal energy.

3. The method of claim 1, further comprising:

controlling the HVAC system of the facility using the first control parameters under each of a plurality of different operating conditions;

aggregating the determined measure of thermal energy delivered by the VAV box and the determined measure of thermal energy delivered by each of the plurality of other VAV boxes of the facility while controlling the HVAC system of the facility using the first control parameters under each of the plurality of different operating conditions;

refining a baseline thermal energy consumption model of the facility based at least in part on the aggregated determined measure of thermal energy delivered by the VAV box and the determined measure of thermal energy delivered by each of the plurality of other VAV boxes of the facility while controlling the HVAC system of the facility using the first control parameters under each of the plurality of different operating conditions;

controlling the HVAC system of the facility using second control parameters under a particular operating condition;

aggregating the determined measure of thermal energy delivered by the VAV box and the determined measure of thermal energy delivered by each of the plurality of other VAV boxes of the facility while controlling the HVAC system of the facility using the second control parameters under the particular operating condition;

comparing the aggregated determined measure of thermal energy delivered by the VAV box and the determined measure of thermal energy delivered by each of the plurality of other VAV boxes of the facility while controlling the HVAC system of the facility using the second control parameters under the particular operating condition with a baseline aggregated measure of thermal energy generated using the baseline thermal energy consumption model; and based at least in part on the comparison, determining a relative performance of controlling the HVAC system of the facility using the second control parameters versus controlling the HVAC system of the facility using the first control parameters.

4. The method of claim 1, wherein the measure of thermal energy delivered by the VAV box to the space when the HVAC system is heating the space is determined by:

when the VAV discharge air temperature ($T_{DAT}$) is greater than the space air temperature ($T_{SPACE}$):

$$\text{Thermal Energy Delivered} = VAV_{FLOWRATE} * Cp * (T_{DAT} - TAHU_{SAT})$$

where, Cp is the specific heat capacity of air; and when the VAV discharge air temperature ($T_{DAT}$) is less than or equal to the space air temperature ($T_{SPACE}$):

$$\text{Thermal Energy Delivered} = 0.$$

5. The method of claim 1, wherein the VAV box includes a VAV heater that when activated adds sensible heat to the VAV discharge air flow to elevate the VAV discharge air temperature ($T_{DAT}$).

6. The method of claim 5, wherein the measure of thermal energy delivered by the VAV box to the space when the HVAC system is cooling the space is determined by:

when the VAV heater is not activated:

$$\text{Thermal Energy Delivered} = VAV_{FLOWRATE} * Cp * (T_{SPACE} - TAHU_{SAT})$$

where, Cp is the specific heat capacity of air; and when the VAV heater is activated:

$$\text{Thermal Energy Delivered} = VAV_{FLOWRATE} * Cp * (T_{DAT} - TAHU_{SAT}).$$

7. The method of claim 6, wherein the VAV heater is activated and deactivated over a period of time, wherein the measure of thermal energy delivered by the VAV box to the space over the period of time when the HVAC system is cooling the space is determining by summing the thermal energy delivered during the times that the VAV heater was not activated and the thermal energy delivered during the times that the VAV heater was activated.

8. The method of claim 1, wherein the measure of thermal energy delivered by the VAV box to the space when the HVAC system is cooling the space is determined by:

$$\text{Thermal Energy Delivered} = VAV_{FLOWRATE} * Cp * -(T_{SPACE} - TAHU_{SAT}).$$

9. The method of claim 1, wherein the VAV box is a fan powered box (FPB) that comprises:

a supply air damper for regulating a flow rate of the supply air ($VAVsupply_{FLOWRATE}$) that is received from the AHU;

a return air intake for receiving a flow of return air ($VAVreturn_{FLOWRATE}$) from the space, wherein the VAV discharge flow rate ($VAV_{FLOWRATE}$) is the sum of the $VAVsupply_{FLOWRATE}$ and the $VAVreturn_{FLOWRATE}$;

a powered fan;

a controller for regulating the supply air damper and the powered fan to achieve a desired ratio of supply air received from the AHU and return air from the space via the return air intake;

wherein the measure of thermal energy delivered by the VAV box to the space is determined by:

when the VAV discharge air temperature ($T_{DAT}$) is greater than the space air temperature ($T_{SPACE}$) and the VAVreturn$_{FLOWRATE}$ is not available:

$$\text{Thermal Energy Delivered} = VAVsupplyflowrate * Cp * (T_{DAT} - TAHU_{SAT}),$$

where Cp is the specific heat capacity of air;

when the VAV discharge air temperature ($T_{DAT}$) is greater than the space air temperature ($T_{SPACE}$) and the VAVreturn$_{FLOWRATE}$ is available:

$$\text{Thermal Energy Delivered} = (VAVsupplyflowrate + VAVreturnflowrate) * Cp * (T_{DAT} - TAHU_{SAT}); \text{ and}$$

when the VAV discharge air temperature ($T_{DAT}$) is less than or equal to the space air temperature ($T_{SPACE}$):

$$\text{Thermal Energy Delivered} = 0.$$

10. The method of claim 9, wherein the VAV box includes a VAV heater that when activated adds sensible heat to the VAV discharge air flow to elevate the VAV discharge air temperature ($T_{DAT}$).

11. The method of claim 1, wherein the VAV box is a fan powered box (FPB) that comprises:

a supply air damper for regulating the flow rate of the supply air (VAVsupply$_{FLOWRATE}$) that is received from the AHU;

a return air intake for receiving a flow of return air (VAVreturn$_{FLOWRATE}$) from the space, wherein the VAV discharge flow rate (VAV$_{FLOWRATE}$) is the sum of the VAVsupply$_{FLOWRATE}$ and the VAVreturn$_{FLOWRATE}$;

a powered fan; and a controller for regulating the supply air damper and the powered fan to achieve a desired ratio of supply air received from the AHU and return air from the space via the return air intake;

wherein the measure of thermal energy delivered by the VAV box to the space is determined by:

when the VAV discharge air temperature ($T_{DAT}$) is greater than the space air temperature ($T_{SPACE}$) and the VAVreturn$_{FLOWRATE}$ is not available:

$$\text{Thermal Energy Delivered} = VAV_{FLOWRTE} * Cp * (T_{DAT} - TAHU_{SAT}),$$

where Cp is the specific heat capacity of air;

when the VAV discharge air temperature ($T_{DAT}$) is greater than the space air temperature ($T_{SPACE}$) and the VAVsupplyflowrate and the VAVreturn$_{FLOWRATE}$ are available:

$$\text{Thermal Energy Delivered} = (VAVsupplyflowrate + VAVreturnflowrate) * Cp * (T_{DAT} - TAHU_{SAT}); \text{ and}$$

when the VAV discharge air temperature ($T_{DAT}$) is less than or equal to the space air temperature ($T_{SPACE}$):

$$\text{Thermal Energy Delivered} = 0.$$

12. The method of claim 1, wherein the VAV box is a fan powered box (FPB) that comprises:

a supply air damper for regulating the flow rate of the supply air (VAVsupply$_{FLOWRATE}$) that is received from the AHU;

a return air intake for receiving a flow of return air (VAVreturn$_{FLOWRATE}$) from the space, wherein the VAV discharge flow rate (VAV$_{FLOWRATE}$) is the sum of the VAVsupply$_{FLOWRATE}$ and the VAVreturn$_{FLOWRATE}$;

a powered fan;

a controller for regulating the supply air damper and the powered fan to achieve a desired ratio of supply air received from the AHU and return air from the space via the return air intake;

a VAV heater that when activated adds sensible heat to the VAV discharge air flow to elevate the VAV discharge air temperature ($T_{DAT}$);

wherein the measure of thermal energy delivered by the VAV box to the space when the HVAC system is cooling the space is determined by:

when the VAV heater is not activated:

$$\text{Thermal Energy Delivered} = (VAVsupplyflowrate + VAVreturnflowrate) * Cp * (T_{SPACE} - TAHU_{SAT}),$$

where, Cp is the specific heat capacity of air; and when the VAV heater is activated:

$$\text{Thermal Energy Delivered} = (VAVsupplyflowrate + VAVreturnflowrate) * Cp * (T_{DAT} - TAHU_{SAT}).$$

13. A Heating, Ventilating and/or Air Conditioning (HVAC) system of a facility, wherein the HVAC system includes a Variable Air Volume (VAV) box receiving a supply air from an Air Handler Unit (AHU) of the HVAC system and providing a VAV discharge air flow to a space of the facility, the HVAC system comprising:

an AHU supply air temperature sensor for providing an AHU supply air temperature (TAHU$_{SAT}$) that is representative of the temperature of the supply air that is received from the AHU by the VAV box;

a VAV discharge air temperature sensor for providing a VAV discharge air temperature ($T_{DAT}$) that is representative of the temperature of the VAV discharge air flow provided to the space by the VAV box;

a space air temperature sensor for providing a space air temperature ($T_{SPACE}$) that is representative of the temperature of the air in the space;

a VAV discharge flow rate sensor for providing a VAV discharge flow rate (VAV$_{FLOWRATE}$) that is representative of a flow rate of the VAV discharge air flow provided to the space by the VAV box;

a controller operatively coupled to the AHU supply air temperature sensor, the VAV discharge air temperature sensor, the space air temperature sensor and the VAV discharge flow rate sensor, the controller configured to:

control the HVAC system of the facility using first control parameters over a first period of time;

determine a measure of thermal energy delivered by the VAV box to the space based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$);

aggregate the determined measure of thermal energy delivered by the VAV box and a determined measure of thermal energy delivered by each of a plurality of other VAV boxes of the facility over the first period of time, resulting in a first aggregated measure of thermal energy;

control the HVAC system of the facility using second control parameters over a second period of time;

determine a measure of thermal energy delivered by the VAV box to the space based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$);

aggregate the determined measure of thermal energy delivered by the VAV box and the determined measure of thermal energy delivered by each of the plurality of other VAV boxes of the facility over the second period of time, resulting in a second aggregated measure of thermal energy; and display the first aggregated measure of thermal energy and the second aggregated measure of thermal energy on a display to help identify the effectiveness in controlling the HVAC system using the first control parameters relative to the second control parameters.

14. The HVAC system of claim 13, wherein the controller is configured to:

change one or more of control parameters of the HVAC system of the facility based at least in part on the first aggregated measure of thermal energy and the second aggregated measure of thermal energy.

15. The HVAC system of claim 13, wherein the controller is configured to:

control the HVAC system of the facility using the first control parameters under each of a plurality of different operating conditions;

aggregate the determined measure of thermal energy delivered by the VAV box and the determined measure of thermal energy delivered by each of the plurality of other VAV boxes of the facility while controlling the HVAC system of the facility using the first control parameters under each of the plurality of different operating conditions;

refine a baseline thermal energy consumption model of the facility based at least in part on the aggregated determined measure of thermal energy delivered by the VAV box and the determined measure of thermal energy delivered by each of the plurality of other VAV boxes of the facility while controlling the HVAC system of the facility using the first control parameters under each of the plurality of different operating conditions;

control the HVAC system of the facility using second control parameters under a particular operating condition;

aggregate the determined measure of thermal energy delivered by the VAV box and the determined measure of thermal energy delivered by each of the plurality of other VAV boxes of the facility while controlling the HVAC system of the facility using the second control parameters under the particular operating condition;

compare the aggregated determined measure of thermal energy delivered by the VAV box and the determined measure of thermal energy delivered by each of the plurality of other VAV boxes of the facility while controlling the HVAC system of the facility using the second control parameters under the particular operating condition with a baseline aggregated measure of thermal energy generated using the baseline thermal energy consumption model; and based at least in part on the comparison, determine a relative performance of controlling the HVAC system of the facility using the second control parameters versus controlling the HVAC system of the facility using the first control parameters.

16. The HVAC system of claim 13, wherein the measure of thermal energy delivered by the VAV box to the space when the HVAC system is heating the space is determined by:

when the VAV discharge air temperature ($T_{DAT}$) is greater than the space air temperature ($T_{SPACE}$):

$$\text{Thermal Energy Delivered} = VAV_{FLOWRATE} * Cp * (T_{DAT} - TAHU_{SAT})$$

where, Cp is the specific heat capacity of air; and when the VAV discharge air temperature ($T_{DAT}$) is less than or equal to the space air temperature ($T_{SPACE}$):

$$\text{Thermal Energy Delivered} = 0.$$

17. The HVAC system of claim 13, wherein the VAV box includes a VAV heater that when activated adds sensible heat to the VAV discharge air flow to elevate the VAV discharge air temperature ($T_{DAT}$).

18. The HVAC system of claim 17, wherein the measure of thermal energy delivered by the VAV box to the space when the HVAC system is cooling the space is determined by:

when the VAV heater is not activated:

$$\text{Thermal Energy Delivered} = VAV_{FLOWRATE} * Cp * (T_{SPACE} - TAHU_{SAT})$$

where, Cp is the specific heat capacity of air; and when the VAV heater is activated:

$$\text{Thermal Energy Delivered} = VAV_{FLOWRATE} * Cp * (T_{DAT} - TAHU_{SAT}).$$

19. A Heating, Ventilating and/or Air Conditioning (HVAC) system of a facility, wherein the HVAC system includes a Variable Air Volume (VAV) box receiving a supply air from an Air Handler Unit (AHU) of the HVAC system and providing a VAV discharge air flow to a space of the facility, the HVAC system comprising:

an AHU supply air temperature sensor for providing an AHU supply air temperature ($TAHU_{SAT}$) that is representative of the temperature of the supply air that is received from the AHU by the VAV box;

a VAV discharge air temperature sensor for providing a VAV discharge air temperature ($T_{DAT}$) that is representative of the temperature of the VAV discharge air flow provided to the space by the VAV box;

a space air temperature sensor for providing a space air temperature ($T_{SPACE}$) that is representative of the temperature of the air in the space;

a VAV discharge flow rate sensor for providing a VAV discharge flow rate ($VAV_{FLOWRATE}$) that is representative of a flow rate of the VAV discharge air flow provided to the space by the VAV box;

a controller operatively coupled to the AHU supply air temperature sensor, the VAV discharge air temperature sensor, the space air temperature sensor and the VAV discharge flow rate sensor, the controller configured to:

control the HVAC system of the facility using first control parameters over each of a plurality of operating conditions;

determine a measure of thermal energy delivered by the VAV box to the space under each of the plurality of operating conditions based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$);

refine a baseline thermal energy consumption model of the facility based at least in part on the determined measure of thermal energy delivered by the VAV box to the space under each of the plurality of operating conditions;

control the HVAC system of the facility using second control parameters under a particular operating condition;

determine a measure of thermal energy delivered by the VAV box to the space under the particular operating condition based at least in part on three or more of the VAV discharge flow rate ($VAV_{FLOWRATE}$), the VAV discharge air temperature ($T_{DAT}$), the space air temperature ($T_{SPACE}$) and the AHU supply air temperature ($TAHU_{SAT}$);

comparing the measure of thermal energy delivered by the VAV box while controlling the HVAC system of the facility using the second control parameters under the particular operating condition with a baseline measure of thermal energy generated using the baseline thermal energy consumption model; and based at least in part on the comparison, determining a relative performance of controlling the HVAC system of the facility using the second control parameters versus controlling the HVAC system of the facility using the first control parameters.

20. The HVAC system of claim 19, wherein the controller is configured to:

change one or more of control parameters of the HVAC system of the facility based at least in part on the determined relative performance of controlling the HVAC system of the facility using the second control parameters versus controlling the HVAC system of the facility using the first control parameters.

* * * * *